US011998974B2

(12) United States Patent
Osgood et al.

(10) Patent No.: US 11,998,974 B2
(45) Date of Patent: Jun. 4, 2024

(54) CASTING CORE FOR A CAST ENGINE COMPONENT

(71) Applicant: GENERAL ELECTRIC COMPANY, Schenectady, NY (US)

(72) Inventors: Daniel Endecott Osgood, Loveland, OH (US); Zachary Daniel Webster, Cincinnati, OH (US); Craig Alan Gonyou, West Chester, OH (US); Daniel Lee Durstock, Fort Wright, KY (US); Kevin R. Feldmann, Evendale, OH (US); Kirk Douglas Gallier, West Chester, OH (US); William C. Herman, West Chester, OH (US); Nicholas Charles Gentilli, Evendale, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/898,751

(22) Filed: Aug. 30, 2022

(65) Prior Publication Data

US 2024/0066588 A1 Feb. 29, 2024

(51) Int. Cl.
*B22C 9/10* (2006.01)

(52) U.S. Cl.
CPC ..... *B22C 9/10* (2013.01)

(58) Field of Classification Search
CPC ..... B22C 9/10
USPC ..... 164/369
See application file for complete search history.

(56) References Cited

U.S. PATENT DOCUMENTS

| | | | |
|---|---|---|---|
| 5,947,181 | A | 9/1999 | Davis |
| 6,186,741 | B1 | 2/2001 | Webb et al. |
| 6,340,047 | B1 | 1/2002 | Frey |
| 6,612,811 | B2 | 9/2003 | Morgan et al. |
| 6,634,859 | B2 | 10/2003 | Weigand et al. |

(Continued)

FOREIGN PATENT DOCUMENTS

| | | | |
|---|---|---|---|
| CN | 1772419 | A | 5/2006 |
| CN | 205085349 | U | 3/2016 |

(Continued)

*Primary Examiner* — Kevin P Kerns
(74) *Attorney, Agent, or Firm* — McGarry Bair PC

(57) ABSTRACT

A casting core used in the manufacture of a cast engine component for a turbine engine, the cast engine component having a first area, a second area, a fluid passage wall separating the first area and the second area, and a connecting fluid passage extending through the fluid passage wall and interconnecting the first area and the second area. The connecting fluid passage having a turn with a radius (R). The casting core having a first core and a second core. The first core and the second core being defined by a set of geometric characteristics having a first minimum equivalent diameter ($D1_{eqmin}$) of the first core and a second minimum equivalent diameter ($D2_{eqmin}$) of the second core. A first flexible geometry factor (FGF1) being equal to:

$$\left(\frac{D1_{eqmin}}{D2_{eqmin}}\right)\left(\frac{R}{D2_{eqmin}}\right).$$

20 Claims, 17 Drawing Sheets

(56) References Cited

U.S. PATENT DOCUMENTS

| | | | | |
|---|---|---|---|---|
| 7,569,172 | B2 | 8/2009 | Pietraszkiewicz et al. | |
| 8,628,294 | B1 | 1/2014 | Liang | |
| 8,636,471 | B2 | 1/2014 | Harris, Jr. et al. | |
| 8,936,068 | B2 | 1/2015 | Lee et al. | |
| 9,057,276 | B2 | 6/2015 | Lee | |
| 9,121,291 | B2 | 9/2015 | Hada | |
| 9,132,476 | B2 | 9/2015 | Lee et al. | |
| 9,216,451 | B2 | 12/2015 | Lee et al. | |
| 9,518,468 | B2 | 12/2016 | Tibbott et al. | |
| 10,190,420 | B2 | 1/2019 | King et al. | |
| 10,526,898 | B2 | 1/2020 | Jennings et al. | |
| 10,695,825 | B2 | 6/2020 | Todorov et al. | |
| 10,927,692 | B2 | 2/2021 | Jones et al. | |
| 11,035,235 | B2 | 6/2021 | Dujol et al. | |
| 11,389,862 | B2 | 7/2022 | Osgood et al. | |
| 11,408,290 | B2 | 8/2022 | Osgood et al. | |
| 2005/0087319 | A1* | 4/2005 | Beals et al. | B22C 9/10 164/45 |
| 2006/0032604 | A1* | 2/2006 | Beck et al. | B22C 9/10 164/349 |
| 2011/0132562 | A1* | 6/2011 | Merrill et al. | B22C 9/02 164/28 |
| 2012/0168108 | A1* | 7/2012 | Farris et al. | B22C 9/103 164/137 |
| 2013/0333855 | A1* | 12/2013 | Merrill et al. | B22C 21/14 164/45 |
| 2014/0102656 | A1* | 4/2014 | Propheter-Hinckley et al. | B22C 9/103 164/137 |
| 2014/0271129 | A1* | 9/2014 | Mueller et al. | F01D 5/186 415/115 |
| 2015/0322799 | A1 | 11/2015 | Xu | |
| 2016/0194965 | A1 | 7/2016 | Spagler | |
| 2018/0283183 | A1 | 10/2018 | Gallier et al. | |
| 2020/0095868 | A1 | 3/2020 | Heneveld | |

FOREIGN PATENT DOCUMENTS

| | | | |
|---|---|---|---|
| CN | 107848020 | A | 3/2018 |
| EP | 3088100 | A1 | 11/2016 |

* cited by examiner

CASTING CORE FOR A CAST ENGINE COMPONENT

TECHNICAL FIELD

The present disclosure relates generally to a casting core, and more specifically to casting core for a cast engine component.

BACKGROUND

A turbine engine typically includes an engine core with a compressor section, a combustor section, and a turbine section in serial flow arrangement. A fan section can be provided upstream of the compressor section. The compressor section compresses air which is channeled to the combustor section where it is mixed with fuel, where the mixture is then ignited for generating hot combustion gases. The combustion gases are channeled to the turbine section which extracts energy from the combustion gases for powering the compressor section, as well as for producing useful work to propel an aircraft in flight or to power a load, such as an electrical generator.

A turbine engine can include engine components having very small connecting fluid passages, which are supplied cooler, pre-combustion, air from the compressor, which cools components exposed to the combustion gases to allow for higher combustion gas temperatures in the combustor section and/or turbine section. These cooling passages are commonly formed during the casting process of the cast engine component.

Casting is a common manufacturing technique for forming various components of a gas turbine aviation engine. Casting a component involves a mold having a shape in the form of a negative of the desired component shape. If a particular internal void is desired, a casting core is placed into the mold. Once the mold is prepared and any casting cores are positioned, molten material is introduced into the mold. After the material cools, the mold is removed, and the casting core may be removed, such as by leaching, from within the cast engine component exposing the internal void.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
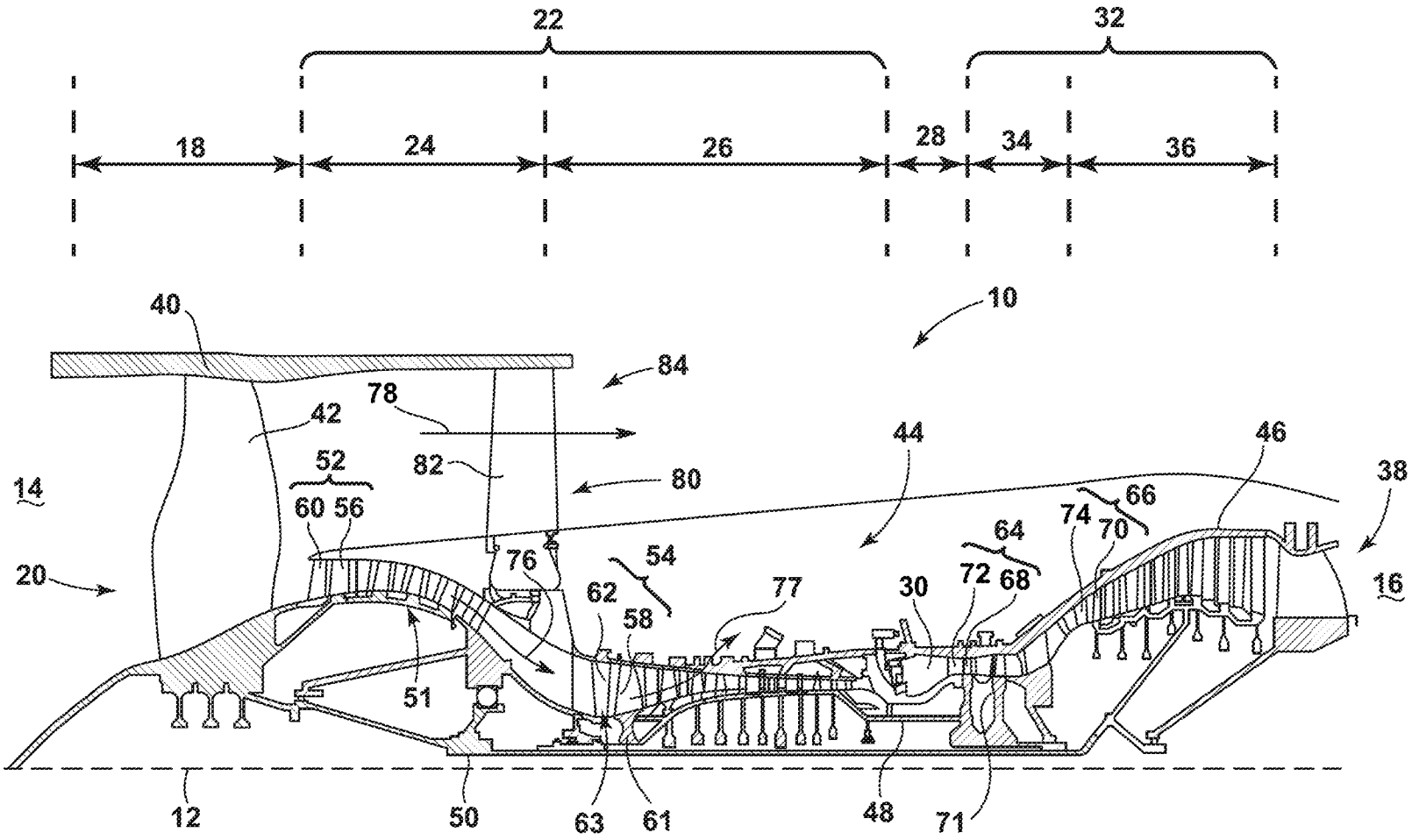
FIG. 1 is a schematic cross-sectional view of a turbine engine in accordance with an exemplary embodiment of the present disclosure.

Aspects of the disclosure herein are directed to a casting core used during the manufacture of a cast engine component. The cast engine component, and thus the casting core, includes a first area and a second area separated by a wall. At least one fluid passage extends through the wall. The fluid passage interconnects the first area and the second area, as such, the fluid passage is herein referred to as a connecting fluid passage. As the at least one connecting fluid passage extends through the wall, the wall is herein referred to as a fluid passage wall. The casting core includes at least one core that when removed from the cast engine component (e.g., after the casting process) defines at least one of the first area, the second area, and the connecting fluid passage. The connecting fluid passage, and more specifically the portion of the at least one core that defines the connecting fluid passage, compared to the rest of the cast engine component, includes a relatively complex geometry. As used herein, the complex geometry refers to any portion of the cast engine component that is relatively small in comparison to the rest of the cast engine component or otherwise includes complex architecture such as bends or curves. The complex geometry of the connecting fluid passage yields a connecting fluid passage that is difficult to cast, presenting unique problems, which must be overcome for a successful casting.

The casting core as described is used to create a cast engine component for a turbine engine, specifically, an airfoil. It should be understood, however, that the disclosure applies to other cast engine components of the turbine engine, not just an airfoil. As a non-limiting example, the casting core is used to create a heat exchanger, a wall or a liner. Further, while described in terms of a casting core used in the manufacture of a cast engine component, it will be appreciated that the present disclosure is applied to any other suitable environment, beyond turbine engines, including any component that is formed through a casting process. In other words, the casting core can be applied to any suitable component that includes a connecting fluid passage with relatively complex geometry that extends through a wall and interconnects a first area to a second area.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The terms "fore" or "forward" mean in front of something and "aft" or "rearward" mean behind something. For example, when used in terms of fluid flow, fore/forward can mean upstream and aft/rearward can mean downstream.

The term "fluid" may be a gas or a liquid, or multi-phase. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) as may be used herein are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

"Diameter" or "hydraulic diameter" (Dh) as used herein is in reference to a hydraulic diameter of one or more cavities or openings (e.g., a cooling hole) of a finished (e.g., manufactured) engine component. It will be appreciated that in some instances a hydraulic diameter of a solid component can be discussed. For example, a casting core, which is used to make the cavities or openings of the finished cast engine component can be said to have the hydraulic diameter(s) of the finished component itself. In cases where a hydraulic diameter of a solid component is discussed, the term "equivalent diameter" ($D_{eq}$) or iterations thereof will be used. It will be appreciated that the equivalent diameter ($D_{eq}$) of a casting core can be equal to the hydraulic diameter (Dh) of the portion of the cast engine component that the casting core defines. Hydraulic diameter is a commonly used term when handling flow in non-circular tubes and channels. When the cross-section is uniform along the tube or channel length, it is defined as $$D_H = \frac{4a}{p}$$

where "a" is the cross-sectional area of the flow and "p" is the wetted perimeter of the cross-section. The hydraulic diameter can further be indirectly related to the Reynolds number of the fluid flow. As such, the hydraulic diameter can be used to at least partially quantify the flow of fluid through an area or pipe. It will be appreciated that the specific calculations for the hydraulic diameter are known and referenced herein without direct reference.

"High" and "Low" as used herein are descriptors with regards to the performance indicator quantities described herein.

"Pressure drop" across an obstacle refers to the change in fluid pressure that occurs when the fluid passes through the obstacle. A pressure drop means the fluid's static pressure immediately upstream of the obstacle minus the fluid's static pressure immediately downstream of the obstacle over the fluid's static pressure immediately upstream of the obstacle, and is expressed as a percentage.

A flexible geometry factor (FGF), as used herein, is in reference to a set of geometric characteristics of a core or a set of cores used in manufacturing the connecting fluid passage and the area surrounding the connecting fluid passage. The flexible geometry factor (FGF) can be used to ensure that the casting core or set of casting cores will create a finished cast engine component including the connecting fluid passage that meets the flow requirements of the connecting fluid passage.

The terms "interior" and "exterior" in relationship to an engine component are defined by their relation to a flow of fluid flowing around the cast engine component (e.g., a working airflow, combustion gases, compressed airflow, etc.). An exterior portion is directly exposed to the fluid flowing around the cast engine component. An interior portion is non-exposed or otherwise indirectly exposed to the flow of fluid flowing around the cast engine component.

Turbine engines include an engine core with a compressor section, combustor section, and turbine section in serial flow arrangement, through which is defined a substantially annular flow path relative to a centerline of the turbine engine. Many components of the turbine engine are made by casting through use of a casting core. The cast engine components include a variety of cast engine components such as, but not limited to, a heat exchanger, a liner (e.g., a combustor liner), or an airfoil. In all cases, the cast engine component includes a wall with a relatively small and complex connecting fluid passage extending therein to interconnect a first area to a second area. A fluid flows through the first area, the second area and the connecting fluid passage during operation of the turbine engine. The fluid includes a variety of fluids such as, but not limited to, a cooling fluid, a pressurized fluid, or a heat transfer fluid.

By way of example, the casting core is used in manufacture of a cast engine component that is an airfoil and the connecting fluid passage connects a low-pressure area to a high-pressure area or a relatively cool area to a relatively hot area. The shape and/or size of the connecting fluid passage, referred to herein as the connecting fluid passage architecture, affects the flow characteristics of the fluid within the connecting fluid passage. The flow characteristics include how the fluid will move through the connecting fluid passage and how the fluid will exit the connecting fluid passage (e.g., at what pressure, velocity, direction, etc.). The flow characteristics directly affect the cooling effectiveness, boundary layer growth, or pressure differential associated with: the fluid within the connecting fluid passage, the fluid as it is emitted into one of the first or second areas, or the fluid in one of the first and second areas. In order to satisfy these flow characteristics, however, the connecting fluid passage, in some instances, needs to have a relatively complex geometry. This complex geometry, historically, is very difficult to manufacture through casting because a complex core shape is required to make the void resulting in a connecting fluid passage that satisfies the needed architecture. Such small and complex cores are prone to breaking or otherwise not forming the complex architecture for the connecting fluid passage as intended during the casting process or otherwise creating a cast engine component with unsatisfactory flow characteristics or material properties.

One or more design objectives, when designing the casting core used in the manufacture of the cast engine component, is to ensure that the complex geometry of the connecting fluid passage is able to be created from a casting process, while still ensuring that the final cast engine component satisfies the flow characteristics described above (e.g., cooling effectiveness, heat transfer requirement, boundary layer losses, pressure drops, etc.). These objectives will be collectively referred to as the component objectives.

One solution to cast the component with the connecting fluid passage having a complex geometry is to select a geometry for the casting cores that one believes, based on education and experience, will result in the desired engine component and then testing the casting cores by either producing a physical cast engine component or modeling/simulating the casting process for the selected core geometries. Currently, this process does not guarantee a cast engine component that will have the desired component objectives. The success of this approach is currently unpredictable. If the approach is successful, the component with the connecting fluid passage can move toward production. If the approach is a not successful, the designer must come up with a new geometry for the casting core and the cast engine component and redo the testing. In most cases, the current approach is not successful the first time, which leads to several iterations of casting cores until a successful geometry is reached. This iterative process is time consuming, costly, and does not guarantee a successful casting core or successful cast engine component that meets the design objections. In instances where multiple connecting fluid passages with differing architecture are needed within a single cast engine component, the difficulties of the current iterative process is compounded, and becomes unwieldy even in moderately complex connecting fluid passages.

The inventors' practice has proceeded in the foregoing manner of designing a casting core used in the manufacture of a cast component having a set of geometric characteristics for the connecting fluid passage, physically casting or simulating the casting of the component, identifying whether or not the component was manufactured as designed and satisfies component objectives, and modifying the cast engine component with new geometric characteristics if the cast engine component cannot be manufactured or does not satisfy component objectives. This process is repeated during the design of several different types of components, such as those shown in FIG. 1.

FIG. 1 is a schematic cross-sectional diagram of a turbine engine 10 for an aircraft. The turbine engine 10 has a generally longitudinally extending axis or engine centerline 12 extending forward 14 to aft 16. The turbine engine 10 includes, in downstream serial flow relationship, a fan section 18 including a fan 20, a compressor section 22 including a booster or low-pressure (LP) compressor 24 and a high-pressure (HP) compressor 26, a combustion section 28 including a combustor 30, a turbine section 32 including an HP turbine 34, and an LP turbine 36, and an exhaust section 38.

The fan section 18 includes a fan casing 40 surrounding the fan 20. The fan 20 includes a plurality of fan blades 42 disposed radially about the engine centerline 12. The HP compressor 26, the combustor 30, and the HP turbine 34 form an engine core 44 of the turbine engine 10, which generates combustion gases. The engine core 44 is surrounded by a core casing 46, which is coupled with the fan casing 40.

An HP shaft or spool 48 disposed coaxially about the engine centerline 12 of the turbine engine 10 drivingly connects the HP turbine 34 to the HP compressor 26. An LP shaft or spool 50, which is disposed coaxially about the engine centerline 12 of the turbine engine 10 within the larger diameter annular HP spool 48, drivingly connects the LP turbine 36 to the LP compressor 24 and fan 20. The spools 48, 50 are rotatable about the engine centerline 12 and couple to a plurality of rotatable elements, which collectively defines a rotor 51.

The LP compressor 24 and the HP compressor 26, respectively, include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 are provided in a ring and extend radially outwardly relative to the engine centerline 12, from a blade platform to a blade tip, while the corresponding static compressor vanes 60, 62 are positioned upstream of and adjacent to the rotating compressor blades 56, 58. It is noted that the number of blades, vanes, and compressor stages shown in FIG. 1 were selected for illustrative purposes only, and that other numbers are possible.

The compressor blades 56, 58 for a stage of the compressor are mounted to a disk 61, which is mounted to the corresponding one of the HP and LP spools 48, 50, with each stage having its own disk 61. The compressor blades 56, 58 may be part of a disk, rather than being mounted to a disk. The vanes 60, 62 for a stage of the compressor are mounted to the core casing 46 in a circumferential arrangement.

The HP turbine 34 and the LP turbine 36, respectively, include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 are provided in a ring and extend radially outwardly relative to the engine centerline 12, from a blade platform to a blade tip, while the corresponding static turbine vanes 72, 74 are positioned upstream of and adjacent to the rotating turbine blades 68, 70. It is noted that the number of blades, vanes, and turbine stages shown in FIG. 1 were selected for illustrative purposes only, and that other numbers are possible.

The turbine blades 68, 70 for a stage of the turbine are mounted to a disk 71, which is mounted to the corresponding one of the HP and LP spools 48, 50, with each stage having a dedicated disk 71. The vanes 72, 74 for a stage of the compressor are mounted to the core casing 46 in a circumferential arrangement.

Complimentary to the rotor portion, the stationary portions of the turbine engine 10, such as the static vanes 60, 62, 72, 74 among the compressor and turbine sections 22, 32 are also referred to individually or collectively as a stator 63. As such, the stator 63 refers to the combination of non-rotating elements throughout the turbine engine 10.

In operation, the airflow exiting the fan section 18 is split such that a portion of the airflow is channeled into the LP compressor 24, which then supplies pressurized airflow 76 to the HP compressor 26, which further pressurizes the air. The pressurized airflow 76 from the HP compressor 26 is mixed with fuel in the combustor 30 and ignited, thereby generating combustion gases. Some work is extracted from the combustion gases by the HP turbine 34, which drives the HP compressor 26. The combustion gases are discharged into the LP turbine 36, which extracts additional work to drive the LP compressor 24, and the exhaust gas is ultimately discharged from the turbine engine 10 via the exhaust section 38. The driving of the LP turbine 36 drives the LP spool 50 to rotate the fan 20 and the LP compressor 24.

A portion of the pressurized airflow 76 is drawn from the compressor section 22 as bleed air 77. The bleed air 77 is drawn from the pressurized airflow 76 and provided to engine components requiring cooling. The temperature of pressurized airflow 76 entering and exiting the combustor 30 is significantly increased. As such, cooling provided by the bleed air 77 is supplied to downstream turbine components (e.g., a turbine blade 68) subjected to the heightened temperature environments.

A remaining portion of the airflow exiting the fan section 18, a bypass airflow 78, bypasses the LP compressor 24 and engine core 44 and exits the turbine engine 10 through a stationary vane row, and more particularly an outlet guide vane assembly 80, comprising a plurality of airfoil guide vanes 82, at a fan exhaust side 84. More specifically, a circumferential row of radially extending airfoil guide vanes 82 are utilized adjacent the fan section 18 to exert some directional control of the bypass airflow 78.

Some of the air supplied by the fan 20 bypasses the engine core 44 and is used for cooling of portions, especially hot portions, of the turbine engine 10, and/or used to cool or power other aspects of the aircraft. In the context of the turbine engine 10, the hot portions refer to a variety of portions of the turbine engine 10 downstream of the combustion section 28 (e.g., the turbine section 32). Other sources of cooling fluid include, but are not limited to, fluid discharged from the LP compressor 24 or the HP compressor 26.

Figure 2:
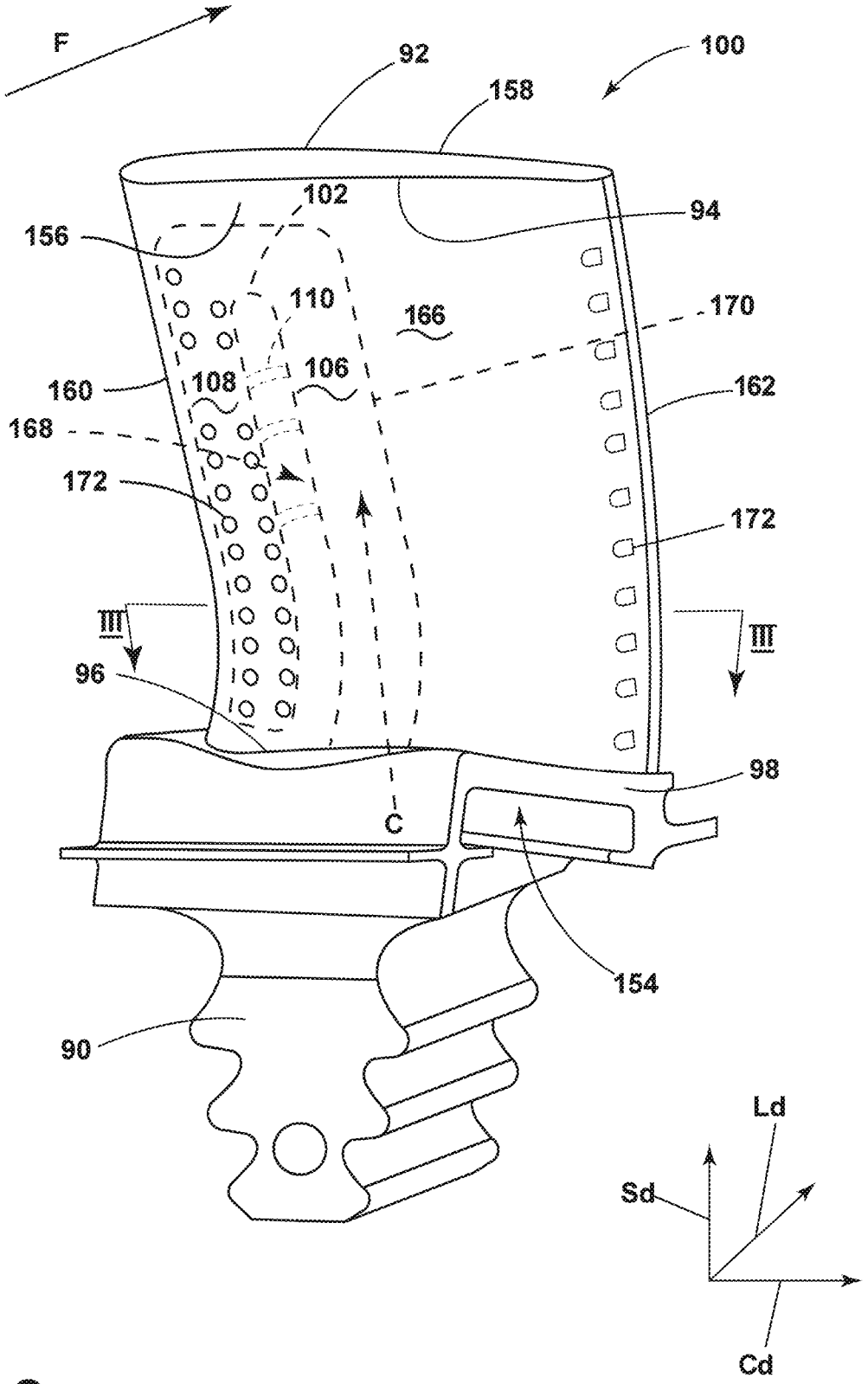
FIG. 2 is a perspective view of an engine component in the form of an airfoil assembly suitable for use within the turbine engine of FIG. 1.

FIG. 2 is a perspective view of a cast engine component 100 suitable for use within the turbine engine 10 of FIG. 1. The cast engine component 100, as illustrated and described, includes an airfoil 92, which can be either a rotating blade or a stationary vane in any part of the turbine engine 10.

The cast engine component 100 includes a dovetail 90 and the airfoil 92. The airfoil 92 extends between a tip 94 and a root 96 to define a span-wise direction (Sd). The airfoil 92 mounts to the dovetail 90 on a platform 98 at the root 96. The dovetail 90 further includes at least one inlet passage 154 extending through the dovetail 90 to provide internal fluid communication with the airfoil 92.

The airfoil 92 includes a first side 156, illustrated as a concave-shaped pressure side, and a second side 158, illustrated as a convex-shaped suction side. The first and second sides 156, 158 are joined together to define an outer wall 166 of the airfoil 92. The airfoil 92 extends between an upstream edge 160, or a leading edge, and a downstream edge 162, or a trailing edge, to define a chord-wise direction (Cd). The outer wall 166 faces a working airflow (F). The working airflow (F), as used herein refers to a variety of suitable airflows within the turbine engine such as, but not limited to, an ambient airflow, a compressed airflow, combustion gases, or any other suitable airflow. An interior 168 of the airfoil 92 includes at least one cooling supply conduit 170, illustrated in dashed line. The at least one cooling supply conduit 170 is fluidly coupled with the inlet passage 154. A cooling fluid flow (C) is supplied from the at least one cooling supply conduit 170. A set of cooling holes 172 are located along a variety of suitable portions of the outer wall 166 including along the upstream edge 160 and downstream edge 162 as illustrated.

The at least one cooling conduit 170 defines an internal area of the cast engine component 100. The at least one cooling supply conduit 170 includes a first fluid path 106 and a second fluid path 108 fluidly coupled to the first fluid path 106 at a turn near the tip 94. A fluid passage wall 102 separates the first and second fluid paths 106, 108. At least one cooling hole of the set of cooling holes 172 is directly fluidly coupled to the second fluid path 108. Further, at least a portion of the cooling holes 172 are provided along the outer wall 166 and fluidly coupled to an interior portion of the airfoil 92 that is not defined by the first fluid path 106 or the second fluid path 108 (e.g., the cooling holes 172 provided near the downstream edge 162).

A set of connecting fluid passages 110 extend through the fluid passage wall 102 and fluidly couple the first fluid path 106 to the second fluid path 108. The set of connecting fluid passages 110 act as linking passages between the first fluid path 106 and the second fluid path 108 and are used to reduce a pressure differential between the first fluid path 106 and the second fluid path 108. The pressure differential is caused by the turn near the tip 94 or changes in cross-sectional areas of the first and second fluid paths 106, 108. As such, the set of connecting fluid passages 110 define a set of linking passages or tie bars.

The cooling fluid flow (C) in the first fluid path 106 is flowing in a first direction, while the cooling fluid flow (C) in the second fluid path 108 is flowing in a second direction. The first direction is opposite the second direction. While the first fluid path 106 and the second fluid path 108 are illustrated as being similar in size, it will be appreciated that they can be of different sizes, along some or all of their respective portions.

For sake of reference, a set of relative reference directions, along with a coordinate system can be applied to the cast engine component 100. A lateral direction (Ld), perpendicular to both the span-wise direction (Sd) and the chord-wise direction (Cd), extends generally into the page. It should be understood that the lateral direction (Ld) and an axial direction are parallel to each other or along different planes depending on the orientation of the airfoil 92 on the platform 98.

Figure 3:
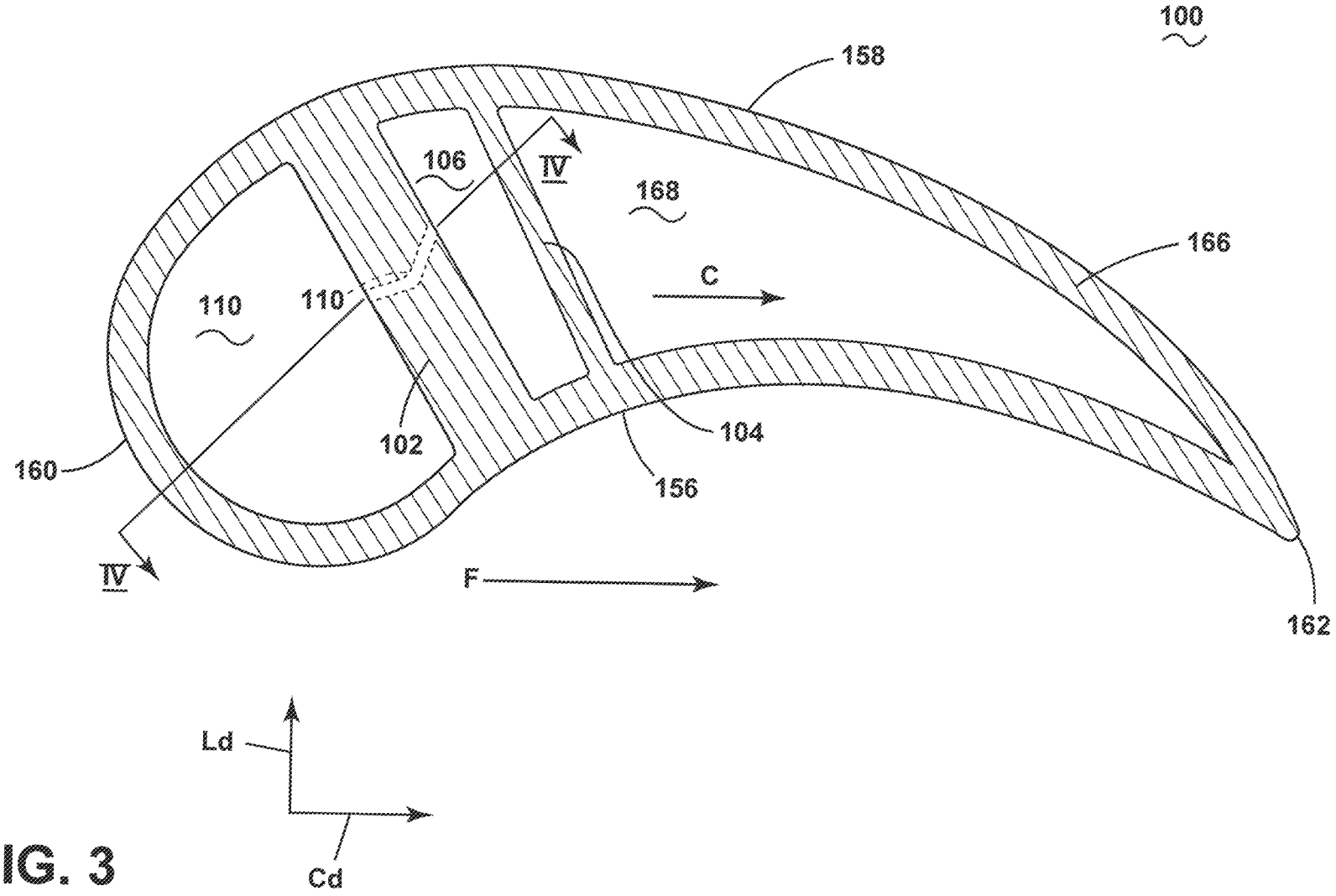
FIG. 3 is a cross-section taken along line III-III of FIG. 2 showing at least one connecting fluid passage extending between a first fluid path and a second fluid path of the cast engine component.

FIG. 3 is a cross-section of the cast engine component 100 and more specifically of the airfoil 92, taken along line III-III of FIG. 2, illustrating the interior 168 defined by the outer wall 166 and including the first fluid path 106 and the second fluid path 108, which are separated by the fluid passage wall 102. One of the connecting fluid passages 110 is shown in dashed lines.

An inner wall 104 is located within the interior 168. The outer wall 166, the fluid passage wall 102 and the inner wall 104 define a set of walls that form the first and second fluid paths 106, 108. The fluid passage wall 102 and the inner wall 104 are ribs that span the interior 168 from the suction side to the pressure side of the outer wall 166. However, the fluid passage wall 102 and the inner walls 104 need not be a rib and could be a variety of suitable inner walls. Similarly, while the connecting fluid passage 110 is shown passing through the fluid passage wall 102, it could just as easily pass through the inner wall 104, or a variety of walls formed within the airfoil 92. Additionally, the connecting fluid passage 110 could also pass through the outer wall 166 thereby connecting the interior 168 to the exterior of the cast engine component 100, which in this illustrated example, is the airfoil 92.

Figure 4A:
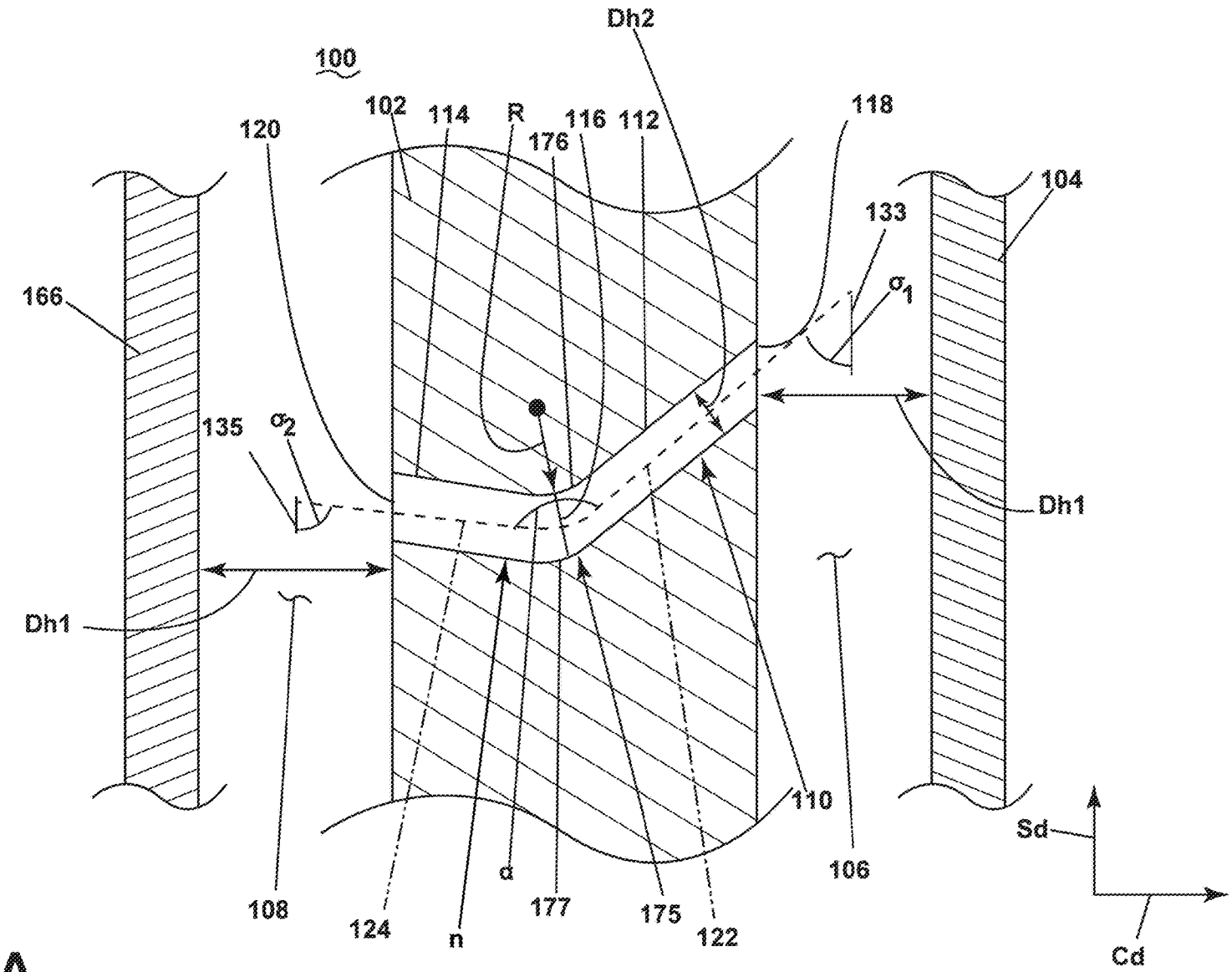
FIG. 4A is a schematic cross-sectional view taken along line IV-IV of FIG. 3, the cast engine component including the at least one connecting fluid passage interconnecting the first fluid path to the second fluid path.

FIG. 4A is a schematic cross-sectional view of the airfoil 92 of FIG. 2 taken from line IV-IV of FIG. 3. The connecting fluid passage 110 includes a first leg 112 and a second leg 114, which meets with the first leg 112 at an intersection 116. The connecting fluid passage 110 extends between a first distal end 118 and a second distal end 120. As illustrated, the first leg 112 terminates at the first distal end 118, while the second leg 114 terminates at the second distal end 120. The first distal end 118 and the second distal end 120 are fluidly coupled to the first fluid path 106 and the second fluid path 108, respectively. While illustrated as two legs 112, 114 with a single intersection 116, the connecting fluid passage 110 can have more than two legs, which form one or more intersections.

As illustrated, the two legs 112, 114 are non-colinear legs connected by a turn 175 having a first bend 176 and a second bend 177. The first bend 176, as illustrated, is an inner bend, while the second bend 177, as illustrated, is an outer bend. The first bend 176 and the second bend 177 each include a respective radius of curvature, with a smaller of the two radius of curvatures defining a radius (R) of the connecting fluid passage 110. The radius (R) forms a tangent point of intersection 116 with the first and second legs 112, 114, respectively. It is possible for there to be no radius (R) when the first and second legs 112, 114 intersect to form a sharp corner, instead of a radius.

The first leg 112 has a first centerline 122. The second leg 114 has a second centerline 124. An angle ($\alpha$) is formed between the first centerline 122 and the second centerline 124. The angle ($\alpha$) is any angle from 0 to 360 degrees, other than 0 and 180 degrees.

While shown as extending within a two-dimensional plane formed by the spanwise (Sd) and chordwise (Cd) axes, it will be appreciated that the at least one connecting fluid passage 110 can extend along any two-dimensional plane or into a three-dimensional space.

The connecting fluid passage 110, as described herein, is included within a set of connecting fluid passages 110 that include a total number of connecting fluid passages (n). The first centerline 122 forms a first distal angle ($\sigma_1$) with a first vertical plane 133 parallel to the spanwise direction (Sd). The second centerline 124 forms a second distal angle ($\sigma_2$) with a second vertical plane 135 parallel to the spanwise direction (Sd). The first distal angle ($\sigma_1$) is equal to or non-equal to the second distal angle ($\sigma_2$). The first distal angle ($\sigma_1$) and the second distal angle ($\sigma_2$) are between 15 degrees and 165 degrees (15 degrees$\leq\sigma_1$, $\sigma_2\leq$165 degrees). The first distal angle ($\sigma_1$) and the second distal angle ($\sigma_2$) are used to position the first distal end 118 and the second distal end 120, respectively, of the at least one connecting fluid passage 110 with respect to the flow of fluid within the respective first fluid path 106 or second fluid path 108.

The first fluid path 106, the second fluid path 108, and the connecting fluid passage 110 are all defined by respective hydraulic diameters. The first fluid path 106 is defined by a first hydraulic diameter (Dh1). The second fluid path 108, like the first fluid path is defined by a first hydraulic diameter (Dh1). The first hydraulic diameter (Dh1) is constant or variable along the extent of the first fluid path 106 and the second fluid path 108, respectively. While the same variable name (Dh1) is used for the hydraulic diameter of the first fluid path 106 and second fluid path 108, the actual value of the hydraulic diameter of the first fluid path 106 need not be equal to the hydraulic diameter of the second fluid path 108. The connecting fluid passage 110 is defined by a second hydraulic diameter (Dh2). The second hydraulic diameter (Dh2) is constant or non-constant between the first distal end 118 and the second distal end 120 of the connecting fluid passage 110.

The at least one connecting fluid passage 110 includes a total length defined by a total distance the first centerline 122 and the second centerline 124 extend. In instances where there are more legs than the first leg 112 and the second leg 114, the total length is a summation of the length that the respective centerline for each leg extends. It is expected in most practical implementations that the total length is greater than the second hydraulic diameter (Dh2). As a non-limiting example, the total length is greater than or equal to 0.5 times the second hydraulic diameter (Dh2).

Figure 4B:
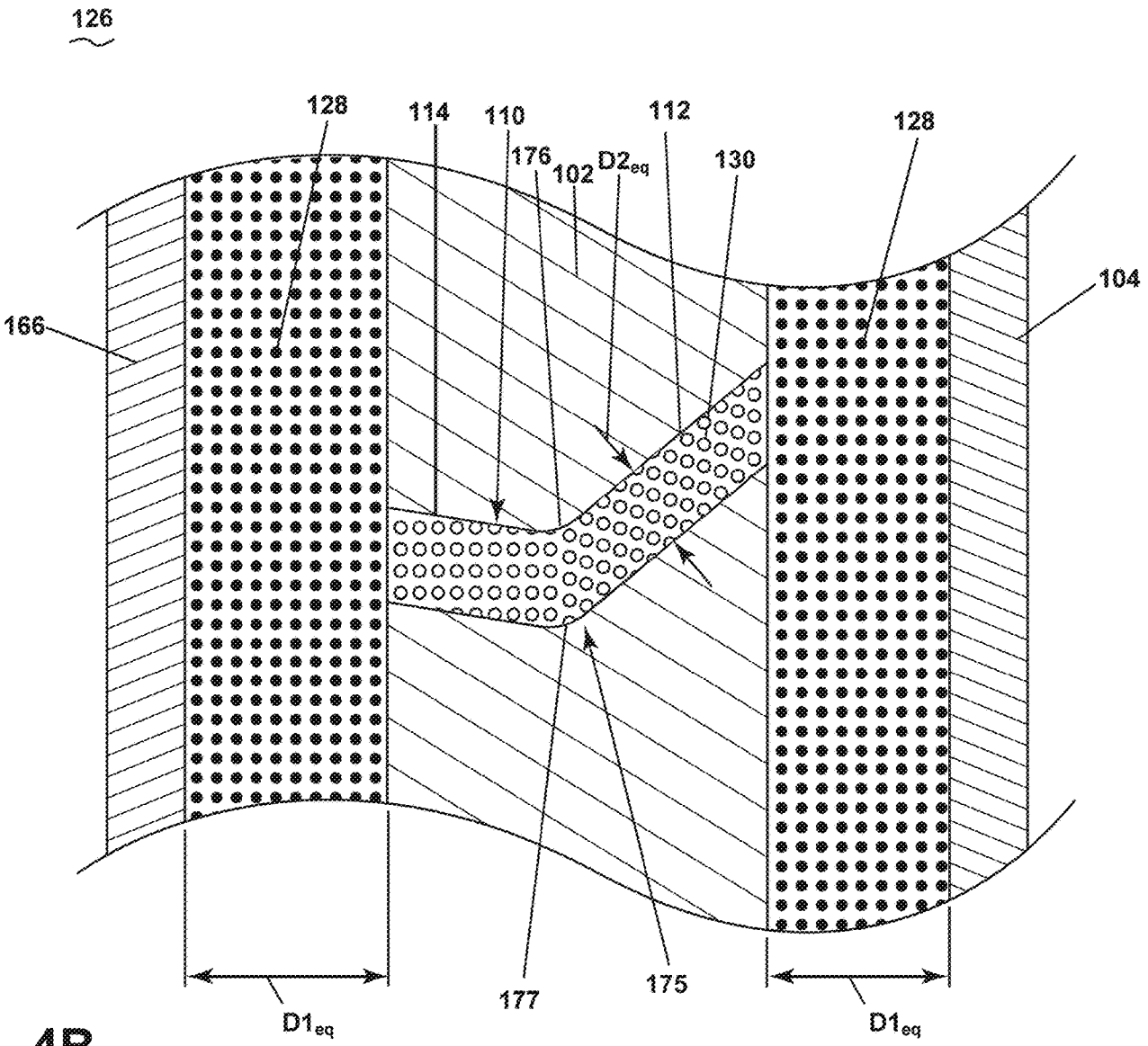
FIG. 4B is schematic cross-sectional view of a casting core used in the manufacture of the cast engine component of FIG. 4A, further comprising a first core and a second core.

FIG. 4B is a schematic cross-sectional view of a portion of a casting core 126 used during the manufacture of the cast engine component 100 of FIG. 4A. The casting core 126 includes at least one core, which is received within a mold (not illustrated). The casting core 126, as illustrated, is after casting or pouring of molten metal has occurred and before the at least one core of the casting core 126 has been removed from the mold. As such, the inner wall 104, the outer wall 166 and the fluid passage wall 102 are all shown as solid components. It will be appreciated that prior to casting, the inner wall 104, the outer wall 166 and the fluid passage wall 102 are at least partially defined by a void or an absence of material. Alternatively, one or more of the inner wall 104, the fluid passage wall 102 or the outer wall 166 are pre-made components.

The casting core 126 includes a first core 128 and a second core 130. The first core 128 corresponds to a location of where the first fluid path 106 (FIG. 4A) and the second fluid path 108 (FIG. 4A) are in the cast engine component 100. The second core 130 corresponds to a location where the connecting fluid passage 110 is in the cast engine component 100.

The first and second cores 128, 130 are made of first and second materials, respectively. The first material and the second material are the same or different materials, such as, but not limited to a ceramic, a refractory metal, a printed ceramic (e.g., through additive manufacturing), or a non-leachable material. Materials used to form the cast engine component 100 include, but are not limited to, steel, refractory metals such as titanium, or superalloys based on nickel, cobalt, or iron, and ceramic matrix composites. In some instances, a portion of the casting core 126 is made from a non-sacrificial or non-leachable material such that the respective portion of the casting core 126 remains within the cast engine component 100 after the sacrificial portions of the casting core 126 have been removed.

The ceramic and refractory material are produced in a variety of suitable ways, such as, but are not limited to, traditional dies, printed dies, any indirect method of making a die such as tomo-lithography, 3D printed ceramics, 3D printed refractory metals, or any combination thereof.

The first and second cores 128, 130 are integrally or non-integrally formed with each other. When integrally formed, the first core 128 and the second core 130 define a unitary core, which is made of a single material or two or more materials. The benefit of using a single continuous core over a plurality of cores is that the plurality of cores need to be coupled to each other or otherwise carefully positioned within the mold with respect to one another to ensure that the final cast engine component 100 is formed as desired. Non-integrally formed cores add a degree of difficulty during the manufacturing of the cast engine component 100. In instances where the first core 128 and the second core 130 are non-integrally formed, they are coupled to each other through a variety of suitable methods such as, but not limited to, adhesion or fastening. In one example, one of either the first core 128 or the second core 130 includes a male piece that extends into a female piece of the other of the first core 128 or the second core 130 in order to couple the first core 128 to the second core 130.

The first core 128 and the second core 130 are each defined by respective equivalent diameters. The first core 128 includes a first equivalent diameter ($D1_{eq}$), which is equal to the first hydraulic diameter (Dh1) (e.g., $D1_{eq}$=Dh1). The second core 130 is defined by a second equivalent diameter ($D2_{eq}$), which is illustrated by opposing arrows along the second core 130, is equal to a second hydraulic diameter (Dh2) of the connecting fluid passage 110 (e.g., $D2_{eq}$=Dh2).

Figure 5A:
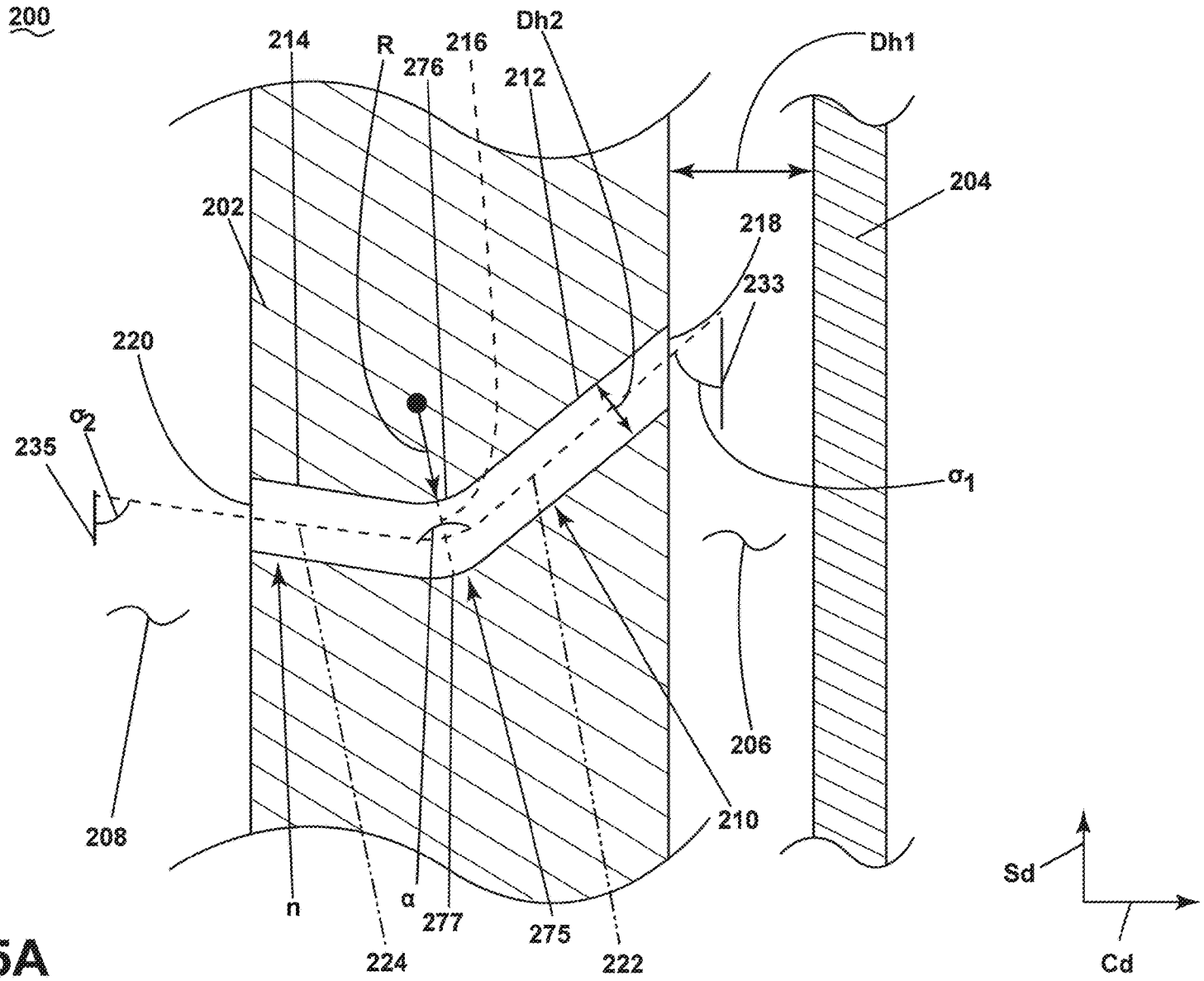
FIG. 5A is a schematic cross-sectional view of an exemplary cast engine component suitable for use within the turbine engine of FIG. 1, further comprising at least one connecting fluid passage interconnecting a first area interior the cast engine component to a second area.

FIG. 5A is a schematic cross-sectional view of another exemplary cast engine component 200 suitable for use within the turbine engine 10 of FIG. 1. The cast engine component 200 is similar to the cast engine component 100, therefore, like parts will be identified with like numerals increased to the 200 series, with it being understood that the description of the like parts of the cast engine component 100 applies to the cast engine component 200 unless otherwise noted.

The cast engine component 200 includes a fluid passage wall 202 separating a first area 206 and a second area 208. At least one connecting fluid passage 210 extends through the fluid passage wall 202 and connects the first area 206 and the second area 208.

The connecting fluid passage 210 extends between a first distal end 218 and a second distal end 220. The connecting fluid passage 210 includes a first leg 212 having a first centerline 222 and a second leg 214 having a second centerline 224. The first leg 212 intersects the second leg 214 at an intersection 216. A turn 275 having a first bend 276 and a second bend 277 is formed along the intersection 216. Each of the first bend 276 and the second bend 277 include a respective radius of curvature, with a smaller of the two defining a radius (R) of the turn 275. The first leg 212 extends between the intersection 216 and the first distal end 218. The second leg 214 extends between the intersection 216 and the second distal end 220.

The first centerline 222 forms a first distal angle ($\sigma$1) with a first vertical plane 233 parallel to the spanwise direction (Sd). The second centerline 224 forms a second distal angle ($\sigma$2) with a second vertical plane 235 parallel to the spanwise direction (Sd). The first area 206 is defined by a first hydraulic diameter (Dh1). The at least one connecting fluid passage 210 is defined by a second hydraulic diameter (Dh2). The at least one connecting fluid passage 210 is included within a set of connecting fluid passages having a total number of connecting fluid passages (n). An angle ($\alpha$) is formed between the first centerline 222 and the second centerline 224.

The cast engine component 200 is similar to the cast engine component 100, except that the fluid passage wall 202 separates an interior area, and more particularly the first area 206, from an area exterior the cast engine component 200, and more particularly the second area 208. In the embodiment of FIG. 5A, the fluid passage wall 202 is an outer wall (e.g., the outer wall 166 (FIG. 3).

The at least one connecting fluid passage 210 is similar to the at least one connecting fluid passage 110, except that the at least one connecting fluid passage 210 is a film hole linking the first area 206 to the second area 208. In other words, fluid passage wall 202 separates an interior area, and more particularly the first area 206, from an area exterior the cast engine component 200, and more particularly the second area 208. In the embodiment of FIG. 5A, the fluid passage wall 202 is an outer wall (e.g., the outer wall 166). As such, the connecting fluid passage 210 interconnects an interior area of the cast engine component 200 to an area exterior the cast engine component 200. The at least one connecting fluid passage 210 transfers a fluid from a low temperature (e.g., within the first area 206) to a high temperature area (e.g., the second area 208) in order to cool a portion of the cast engine component 200 that is confronting the second area 208. The at least one connecting fluid passage 210 is further used to limit boundary layer growth along a portion of the fluid passage wall 202 confronting the second area 208.

The first area 206 may be any of a variety of suitable interior portions such as, but not limited to, an interior cavity, a metering section for a film hole, a manifold, a fluid path (e.g., the first fluid path 106), or a near wall cooling circuit, to name a few non-limiting examples.

The connecting fluid passage 210 is a variety of suitable cooling holes, extending from an interior to the exterior of the cast engine component 200. Non-limiting examples include a film hole along the leading edge, trailing edge or tip rail of an airfoil, a film hole in a platform forming either an upper or lower band, or a cooling hole in a shroud.

The first centerline 222 forms a first distal angle ($\sigma_1$) with a first vertical plane 233 parallel to the spanwise direction (Sd). The second centerline 224 forms a second distal angle ($\sigma_2$) with a second vertical plane 235 parallel to the spanwise direction (Sd). The first area 206 is defined by a first hydraulic diameter (Dh1). The at least one connecting fluid passage 210 is defined by a second hydraulic diameter (Dh2). The at least one connecting fluid passage 210 is included within a set of connecting fluid passages having a total number of connecting fluid passages (n). An angle ($\alpha$) is formed between the first centerline 222 and the second centerline 224.

Figure 5B:
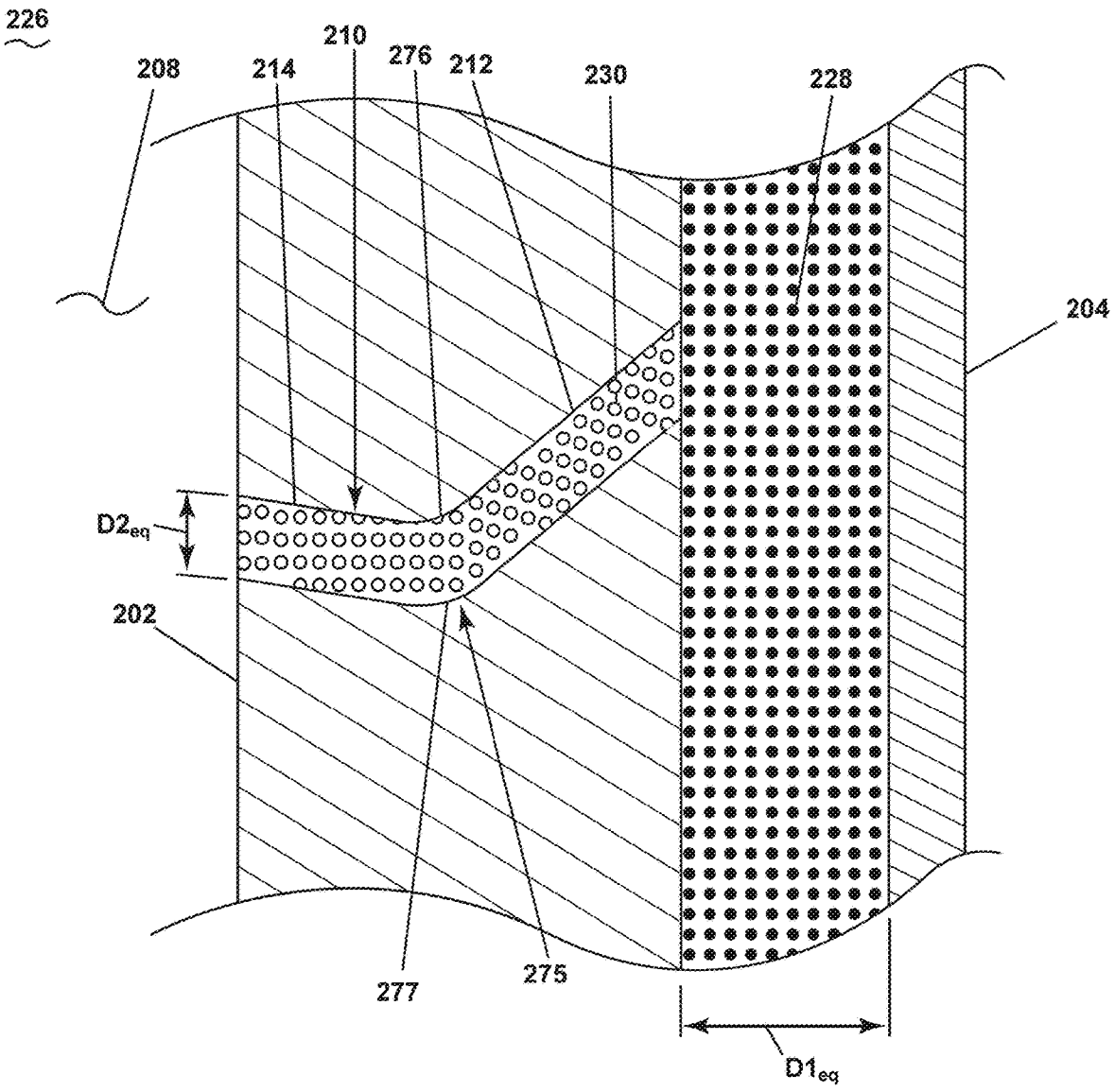
FIG. 5B is schematic cross-sectional view of an exemplary casting core used in the manufacture of the cast engine component of FIG. 5A, further comprising a first core and a second core.

FIG. 5B is schematic cross-sectional view of a portion of an exemplary casting core 226 used during the manufacture of the cast engine component 200 of FIG. 5A. The casting core 226 is similar to the casting core 126, thus like parts will be identified with like numerals increased to the 200 series.

The casting core 226 includes at least one core defining the first area 206 (FIG. 5A) and the connecting fluid passage 210. The casting core 226, for example, includes a first core 228 that defines the first area 206 and a second core 230 that defines the connecting fluid passage 210. The first core 228 and the second core 230 are continuous or otherwise integrally formed, or non-continuous or non-integrally formed. The first core 228 and the second core 230 include the same or different core materials. The fluid passage wall 202 and the inner wall 204 are pre-made components or made during the casting process. Prior to casting, at least one of the inner wall 204 or the fluid passage wall 202 are voids.

The first core 228 is defined by a first equivalent diameter ($D1_{eq}$). The second core 230 is defined by a minimum hydraulic diameter defining a second equivalent diameter ($D2_{eq}$).

Figure 6:
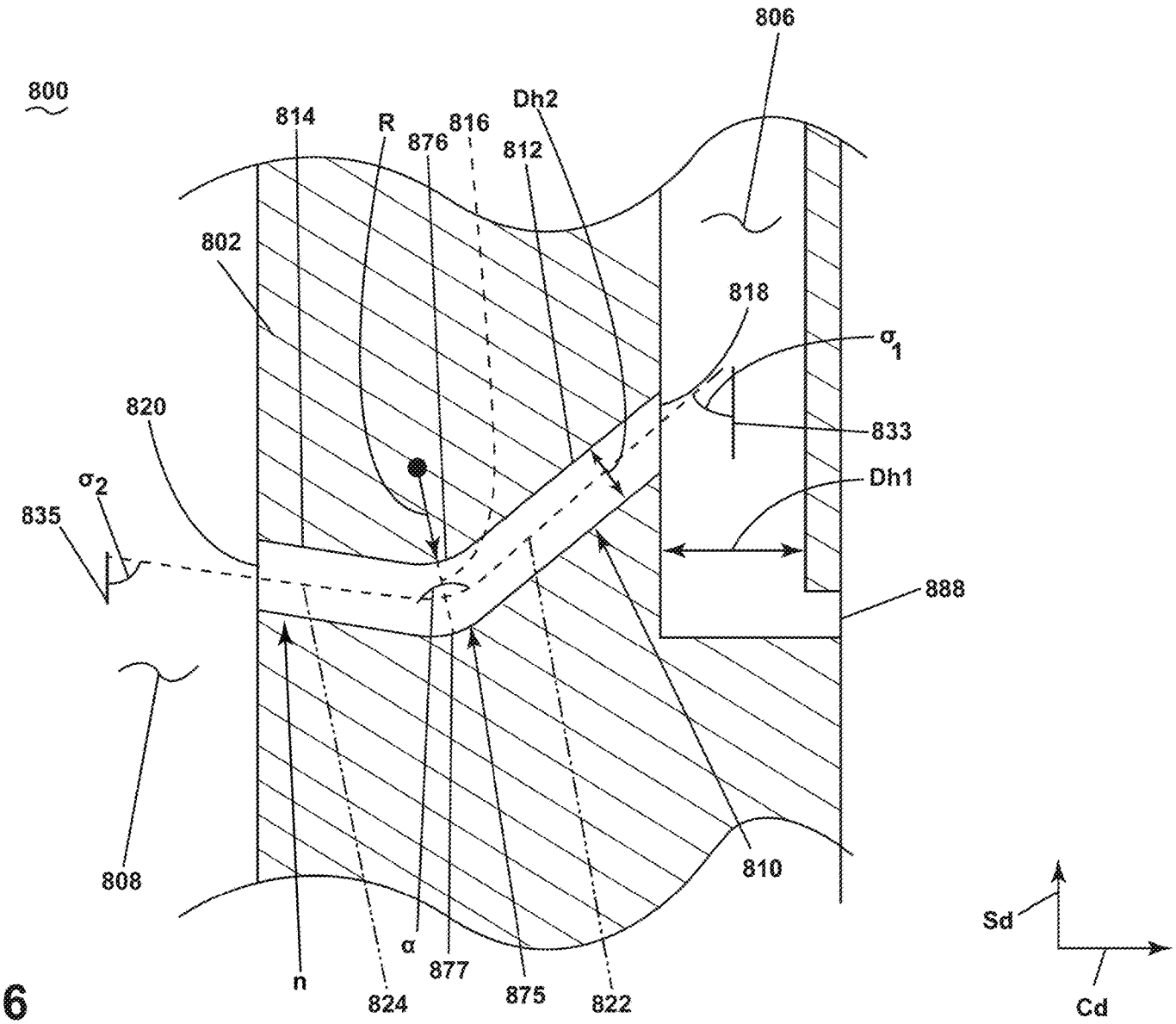
FIG. 6 is a schematic cross-sectional representation of an exemplary cast engine component suitable for use within the turbine engine of FIG. 1, further including a connecting fluid passage extending through a fluid passage wall and fluidly interconnecting a first area formed within the fluid passage wall and a second area.

FIG. 6 is a schematic cross-sectional view of another exemplary cast engine component 800 suitable for use within the turbine engine 10 of FIG. 1. The cast engine component 800 is similar to the cast engine component 100, 200, therefore, like parts will be identified with like numerals increased to the 800 series, with it being understood that the description of the like parts of the cast engine component 100, 200 applies to the cast engine component 800 unless otherwise noted.

The cast engine component 800 includes a fluid passage wall 802 separating a first area 806 and a second area 808. At least one connecting fluid passage 810 extends through the fluid passage wall 802 and connects the first area 806 and the second area 808.

The connecting fluid passage 810 extends between a first distal end 818 and a second distal end 820. The connecting fluid passage 810 includes a first leg 812 having a first centerline 822 and a second leg 814 having a second centerline 824. The first leg 812 intersects the second leg 814 at an intersection 816. A turn 875 having a first bend 876 and a second bend 877 is formed along the intersection 816. Each of the first bend 876 and the second bend 877 include a respective radius of curvature, with a smaller of the two defining a radius (R) of the turn 875. The first leg 812 extends between the intersection 816 and the first distal end 818. The second leg 814 extends between the intersection 816 and the second distal end 820.

The first centerline 822 forms a first distal angle ($\sigma_1$) with a first vertical plane 833 parallel to the spanwise direction (Sd). The second centerline 824 forms a second distal angle ($\sigma_2$) with a second vertical plane 835 parallel to the spanwise direction (Sd). The first area 806 is defined by a first hydraulic diameter (Dh1). The at least one connecting fluid passage 810 is defined by a second hydraulic diameter (Dh2). The at least one connecting fluid passage 810 is included within a set of connecting fluid passages having a total number of connecting fluid passages (n). An angle ($\alpha$) is formed between the first centerline 822 and the second centerline 824.

The cast engine component 800 is similar to the cast engine component 200 of FIG. 5A in that the first area 806 is formed within the cast engine component 800, while the second area 808 is exterior the cast engine component 800. The difference being that the first area 806 is formed within the fluid passage wall 802. As illustrated, the first area 806 is a fluid manifold that extends through the fluid passage wall 802 and is fluidly coupled to the connecting fluid passage 810. It will be appreciated that the first area 806 is fluidly coupled to any number of one or more connecting fluid passages 810. The first area includes an inlet 888, which is configured to receive a flow of fluid (e.g., the cooling fluid flow (C) of FIG. 2), which is ultimately supplied to the connecting fluid passage 810. While described in terms of a fluid manifold, the first area 806 is a variety of structures formed within the fluid passage wall 802 such as, but not limited to a metering section formed of the connecting fluid passage 810. As the first area 806 is formed within the connecting fluid passage 802, the first area 806 is defined as a portion of the connecting fluid passage 810 or vice-versa.

While not shown, the cast engine component 800 is manufactured through use of a casting core like the casting core 126 (FIG. 4B), 226 (FIG. 5B). The casting core used in the manufacture of the cast engine component 800 includes a first core and a second core, with the first core defining the first area 806 and the second core defining the connecting fluid passage 810. The first core and the second core are integrally formed or non-integrally formed with each other and include the same or different materials.

Figure 7:
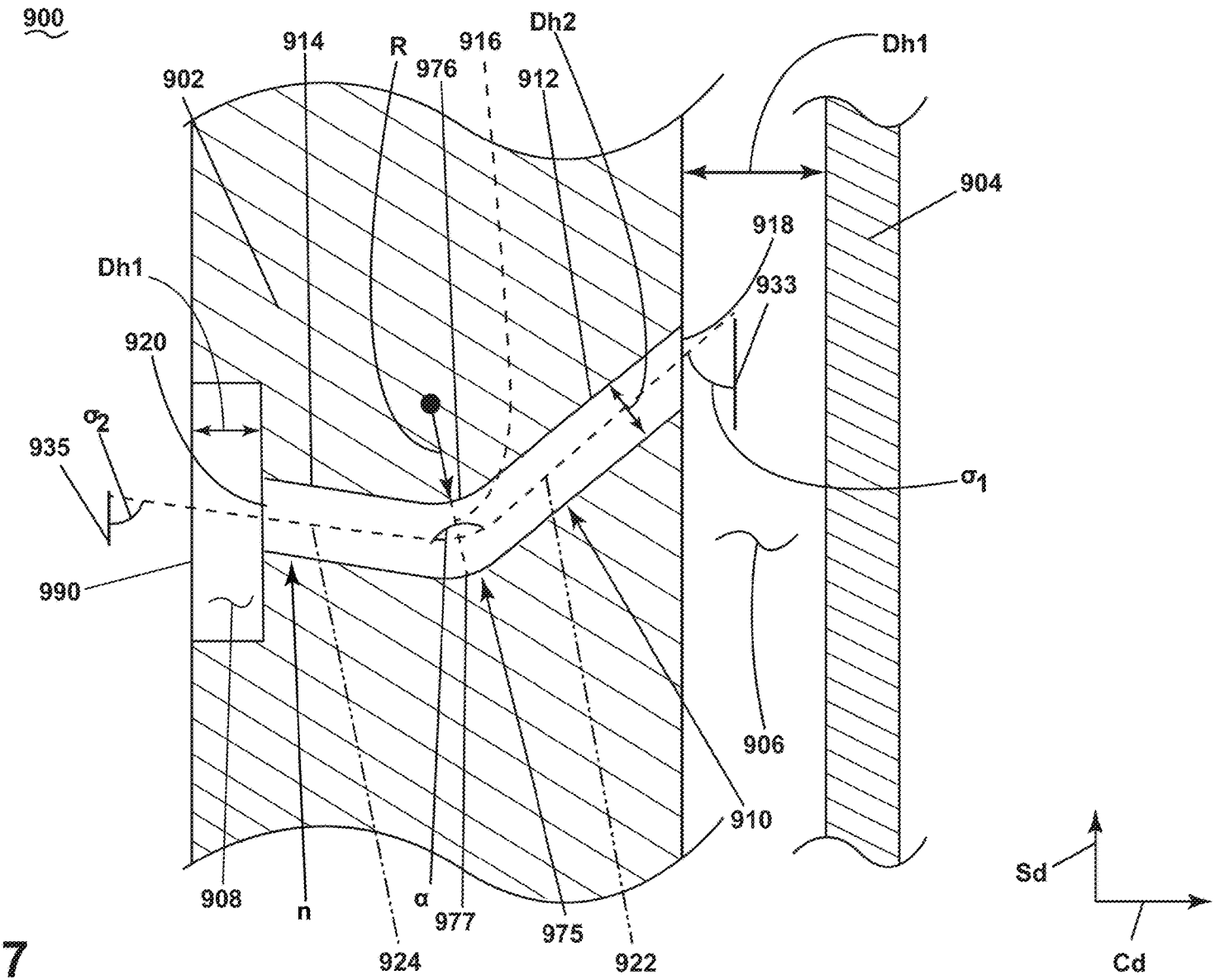
FIG. 7 is a schematic cross-sectional representation of an exemplary cast engine component suitable for use within the turbine engine of FIG. 1, further including a connecting fluid passage extending through a fluid passage wall and fluidly interconnecting a second area formed within the fluid passage wall and a first area.

FIG. 7 is a schematic cross-sectional view of another exemplary cast engine component 900 suitable for use within the turbine engine 10 of FIG. 1. The cast engine component 900 is similar to the cast engine component 100, 200, 800, therefore, like parts will be identified with like numerals increased to the 900 series, with it being understood that the description of the like parts of the cast engine component 100, 200, 800 applies to the cast engine component 900 unless otherwise noted.

The cast engine component 900 includes a fluid passage wall 902 separating a first area 906 and a second area 908. The first area 906 is at least partially defined by an interior wall 904 and the fluid passage wall 902. At least one connecting fluid passage 910 extends through the fluid passage wall 902 and connects the first area 906 and the second area 908.

The connecting fluid passage 910 extends between a first distal end 918 and a second distal end 920. The connecting fluid passage 910 includes a first leg 912 having a first centerline 922 and a second leg 914 having a second centerline 924. The first leg 912 intersects the second leg 914 at an intersection 916. A turn 975 having a first bend 976 and a second bend 977 is formed along the intersection 916. Each of the first bend 976 and the second bend 977 include a respective radius of curvature, with a smaller of the two defining a radius (R) of the turn 975. The first leg 912 extends between the intersection 916 and the first distal end 918. The second leg 914 extends between the intersection 916 and the second distal end 920.

The first centerline 922 forms a first distal angle ($\sigma_1$) with a first vertical plane 933 parallel to the spanwise direction (Sd). The second centerline 924 forms a second distal angle ($\sigma_2$) with a second vertical plane 935 parallel to the spanwise direction (Sd). The first area 906 and the second area 908 are each defined by a respective first hydraulic diameter (Dh1). The at least one connecting fluid passage 910 is defined by a second hydraulic diameter (Dh2). The at least one connecting fluid passage 910 is included within a set of connecting fluid passages having a total number of connecting fluid passages (n). An angle ($\alpha$) is formed between the first centerline 922 and the second centerline 924.

The cast engine component 900 is similar to the cast engine component 100 of FIG. 4A in that the first area 906 and the second area 908 are each formed within the cast engine component 900. The difference being that the second area 908 is formed within the fluid passage wall 902. As illustrated, the second area 908 is a diffuser. The second area includes an outlet 990, which is configured to receive a flow of fluid form the connecting fluid passage 910. The second area 908 is said to form a portion of the connecting fluid passage 910 within the fluid passage wall 902.

While not shown, the cast engine component 900 is manufactured through use of a casting core like the casting core 126 (FIG. 4B), 226 (FIG. 5B). The casting core used in the manufacture of the cast engine component 900 includes a first core and a second core, with the first core defining the first area 906 and the second core defining the connecting fluid passage 910. The first core and the second core are integrally formed or non-integrally formed with each other and include the same or different materials.

Figure 8:
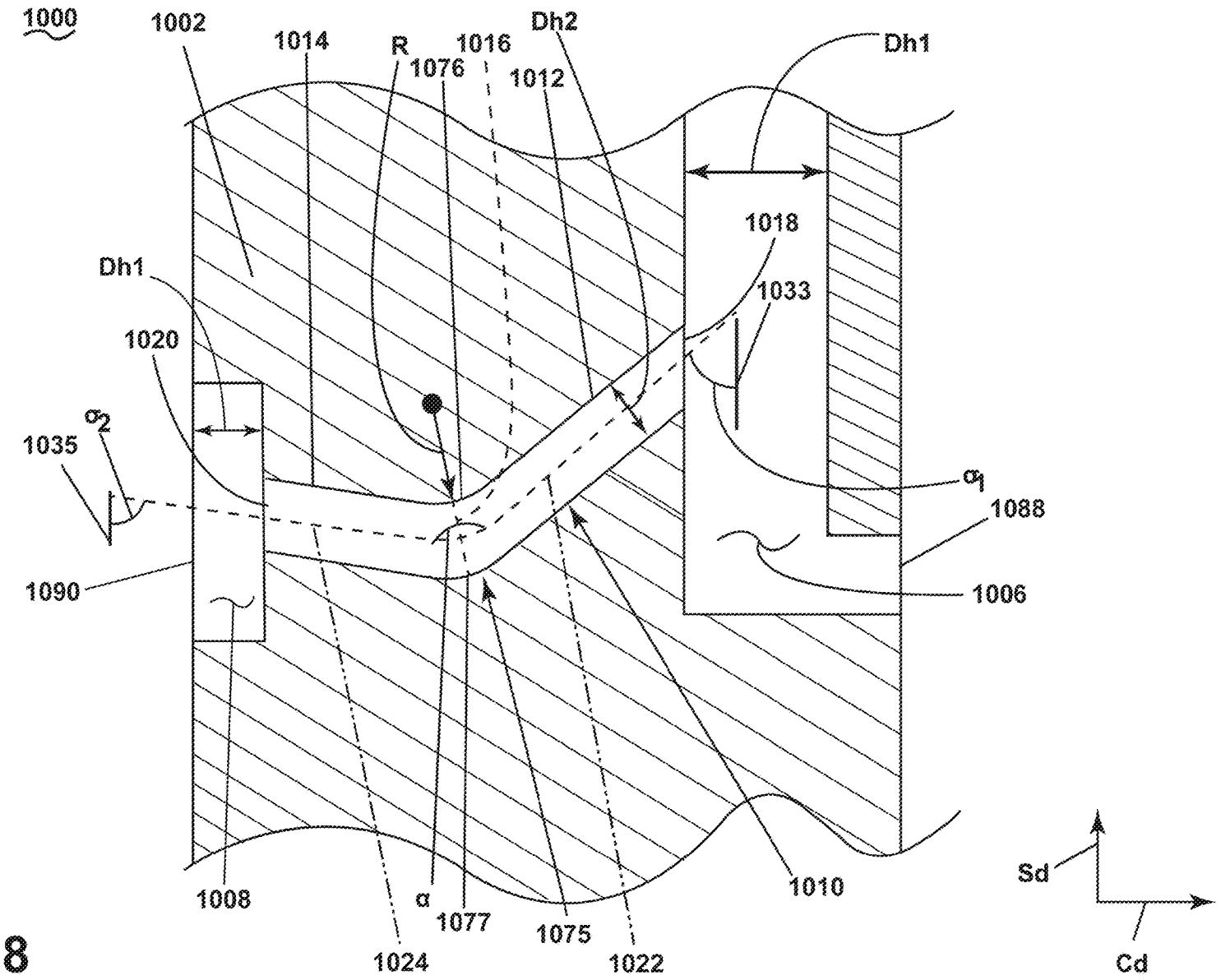
FIG. 8 is a schematic cross-sectional representation of an exemplary cast engine component suitable for use within the turbine engine of FIG. 1, further including a connecting fluid passage extending through a fluid passage wall and fluidly interconnecting a first area and second area both formed within the fluid passage wall.

FIG. 8 is a schematic cross-sectional view of another exemplary cast engine component 1000 suitable for use within the turbine engine 10 of FIG. 1. The cast engine component 1000 is similar to the cast engine component 100, 200, 800, 900, therefore, like parts will be identified with like numerals increased to the 1000 series, with it being understood that the description of the like parts of the cast engine component 100, 200, 800, 900 applies to the cast engine component 1000 unless otherwise noted.

The cast engine component 1000 includes a fluid passage wall 1002 separating a first area 1006 and a second area 1008. At least one connecting fluid passage 1010 extends through the fluid passage wall 1002 and connects the first area 1006 and the second area 1008.

The connecting fluid passage 1010 extends between a first distal end 1018 and a second distal end 1020. The connecting fluid passage 1010 includes a first leg 1012 having a first centerline 1022 and a second leg 1014 having a second centerline 1024. The first leg 1012 intersects the second leg 1014 at an intersection 1016. A turn 1075 having a first bend 1076 and a second bend 1077 is formed along the intersection 1016. Each of the first bend 1076 and the second bend 1077 include a respective radius of curvature, with a smaller of the two defining a radius (R) of the turn 1075. The first leg 1012 extends between the intersection 1016 and the first distal end 1018. The second leg 1014 extends between the intersection 1016 and the second distal end 1020.

The first centerline 1022 forms a first distal angle ($\sigma_1$) with a first vertical plane 1033 parallel to the spanwise direction (Sd). The second centerline 1024 forms a second distal angle ($\sigma_2$) with a second vertical plane 1035 parallel to the spanwise direction (Sd). The first area 1006 is defined by a first hydraulic diameter (Dh1). The at least one connecting fluid passage 1010 is defined by a second hydraulic diameter (Dh2). The at least one connecting fluid passage 1010 is included within a set of connecting fluid passages having a total number of connecting fluid passages (n). An angle ($\alpha$) is formed between the first centerline 1022 and the second centerline 1024.

The cast engine component 1000 is essentially a combination of the cast engine component 800 and the cast engine component 900. In other words, the cast engine component 1000 includes the first area 1006 and the second area 1008, with each being formed within the fluid passage wall 1002. The first area 1006, for example, is a fluid manifold with an inlet 1088. The second area 1008, for example, is a diffuser with an outlet 1090. A fluid flows from the inlet 1088, through the first area 1006, into the connecting fluid passage 1010, into the second area 1008 and ultimately out the outlet 1090. The inlet 1088 is fluidly coupled to an interior portion of the cast engine component 1000 or otherwise to a fluid, the outlet 1090 is fluidly coupled to an interior portion of the cast engine component 1000 or exterior to the cast engine component 1000.

While not shown, the cast engine component 1000 is manufactured through use of a casting core like the casting core 126 (FIG. 4B), 226 (FIG. 5B). The casting core used in the manufacture of the cast engine component 1000 includes a first core and a second core, with the first core defining the first area 1006 and the second area 1008, and the second core defining the connecting fluid passage 1010. The first core and the second core are integrally formed or non-integrally formed with each other and include the same or different materials.

Figure 9:
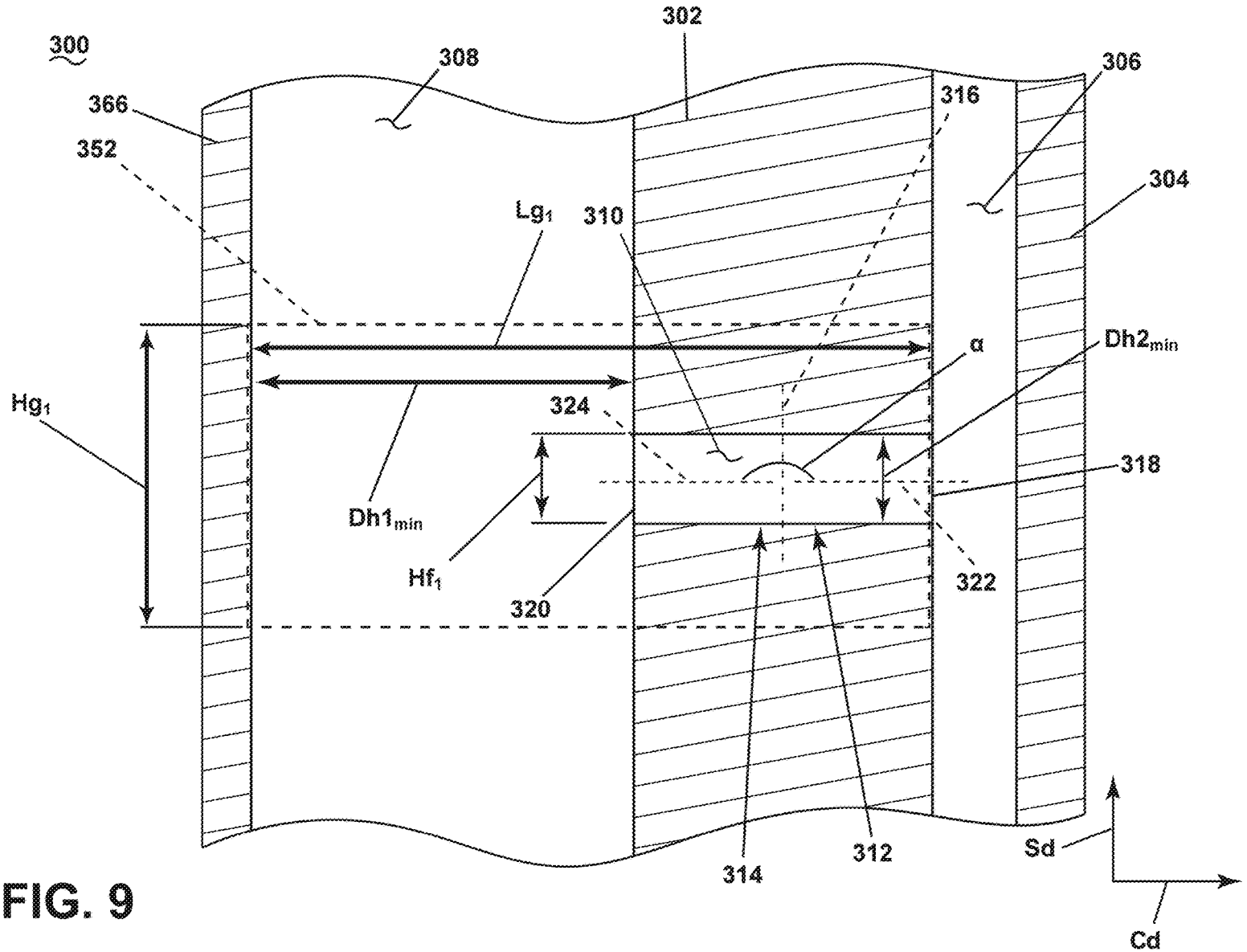
FIG. 9 is a schematic cross-sectional view of the cast engine component of one of FIGS. 4A-8, further illustrating a first geometric boundary.
Figure 10:
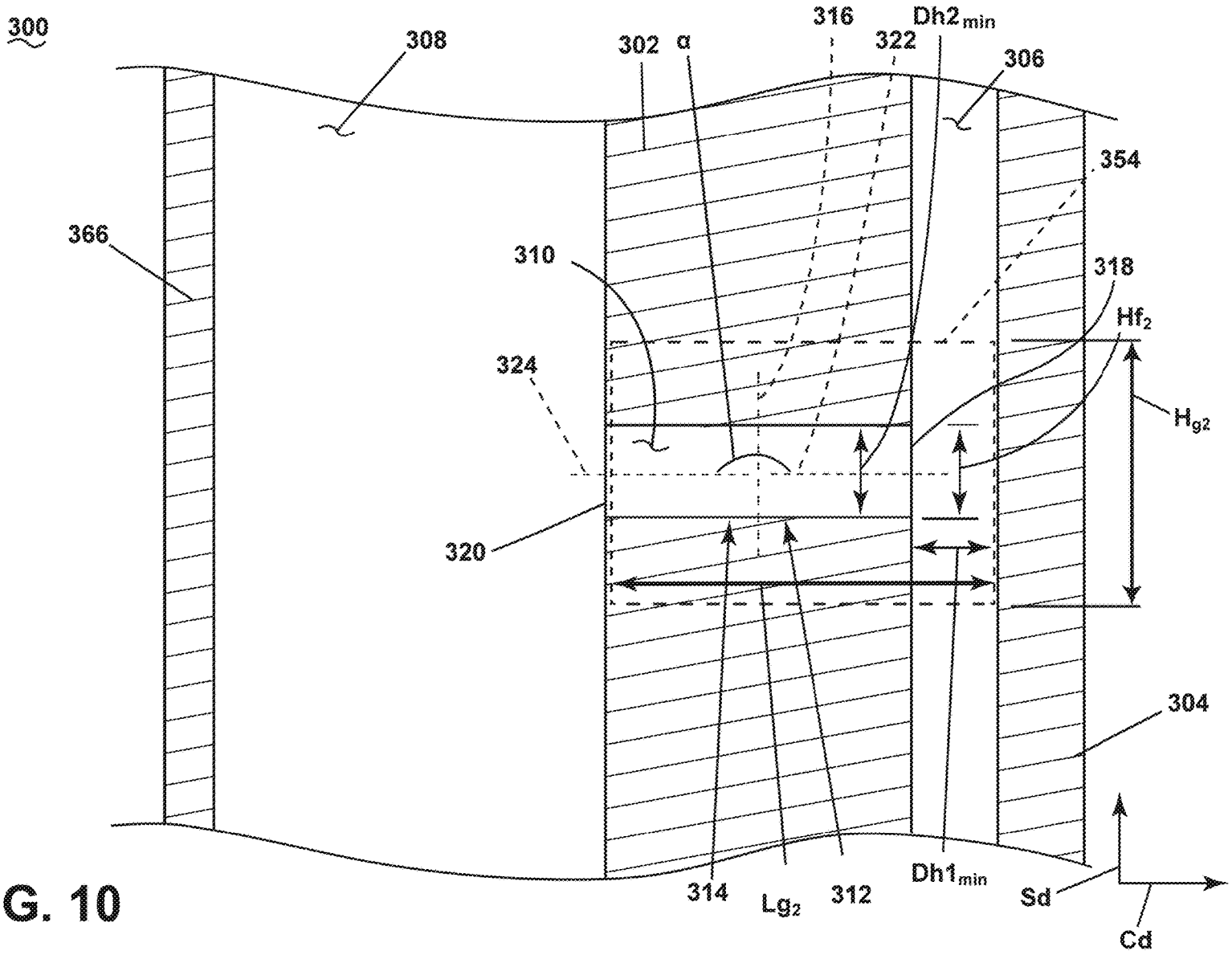
FIG. 10 is the schematic cross-sectional view of the cast engine component of FIG. 9, further illustrating a second geometric boundary.
Figure 11:
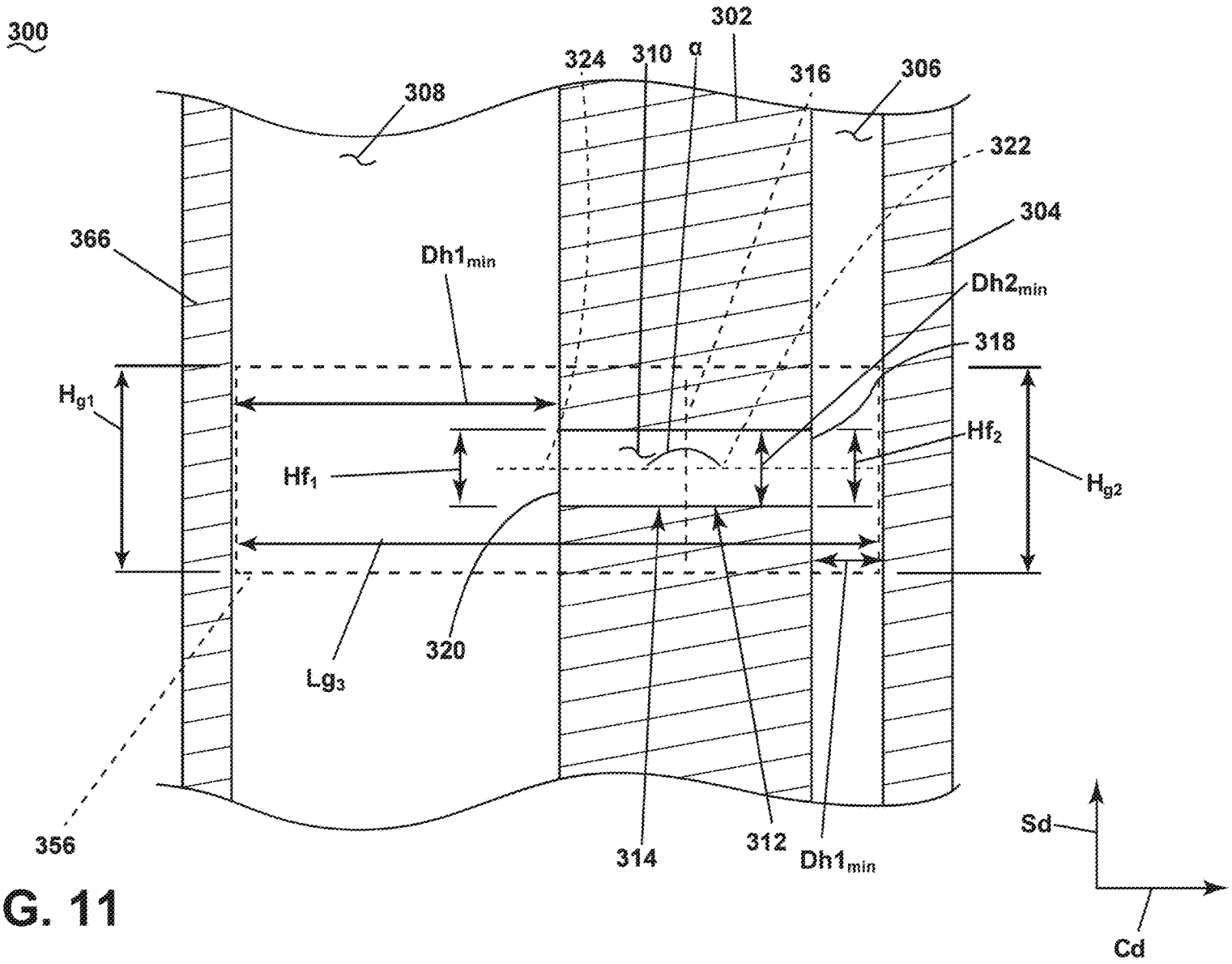
FIG. 11 is the schematic cross-sectional view of the cast engine component of FIG. 9, further illustrating a third geometric boundary.

FIGS. 9-11 illustrate a 2-dimensional, linearized model of an exemplary cast engine component 300 suitable for use as the cast engine component 100, 200, 800, 900, 1000. The cast engine component 300 is cast through use of a casting core like the casting core 126 (FIG. 4B), 226 (FIG. 5B). The 2D, linearized model is used to model real-life scenarios that the inventors use to extract geometric characteristics of the cast engine component 300. The real-life scenarios, as described herein, are used for what will be referred to herein as a core-to-ligament structure (FIG. 9), a ligament-to-core structure (FIG. 10), and a core-to-core structure (FIG. 11). The three real-life scenarios or structures will be described in greater detail below.

The model cast engine component 300 is similar to the cast engine component 100, 200, 800, 900, 1000, therefore, like parts will be identified with like numerals in the 300 series with it being understood that the description of like parts of the cast engine component 100, 200, 800, 900, 1000 applies to the cast engine component 300 unless indicated otherwise.

The cast engine component 300 is a variety of cast engine components such as the cast engine components 100 or of FIGS. 4A-4B, the cast engine component 200 of FIGS. 5A-5B, the cast engine component 800 of FIG. 6, the cast engine component 900 of FIG. 7, the cast engine component 1000 of FIG. 8, or any other suitable cast engine component (e.g., a heat exchanger or a liner). For the sake of reference, the cast engine component 300 is described in terms of a finished cast engine component. It will be appreciated, however, that the cast engine component 300 is manufactured through use of a casting core (e.g., the casting core 126 (FIG. 4B) or the casting core 226 (FIG. 5B)). The cast engine component 300 includes hydraulic diameters that are used as the equivalent diameters of a casting core that is used in the manufacture of the cast engine component 300.

The cast engine component 300 includes at least one connecting fluid passage 310 extending through a fluid passage wall 302 separating a first area 306 and a second area 308. In the illustrated environment, the fluid passage wall 302 is a wall provided between an outer wall 366 and an inner wall 304. It will be appreciated, however, that the second area 308 is an interior area of the cast engine component 300 or an area that is exterior the cast engine component 300. As such, the fluid passage wall 302 is an inner wall or an outer wall (e.g., the outer wall 366). The at least one connecting fluid passage 310 includes a first leg 312 having a first centerline 322 and a second leg 314 having a second centerline 324. The connecting fluid passage 310 extends between a first distal end 318 and a second distal end 320. The first leg 312 confronts the first area 306 at the first distal end 318. The second leg 314 confronts the second area 308 at the second distal end 320. The first leg 312 meets the second leg 314 at an intersection 316. An angle ($\alpha$) is formed between the first centerline 322 and the second centerline 324.

In the core-to-ligament structure, the at least one connecting fluid passage 310 is formed by a core or a portion of a core (e.g., the second core 130 (FIG. 4B)) that is directly coupled to the second area 308, which is defined by a core or a portion of a core (e.g., the first core 128 (FIG. 4B)). The core-to-ligament structure applies to the cast engine component 100 and the casting core 126 (FIGS. 4A and 4B, respectively), the cast engine component 900 (FIG. 7) and the cast engine component 1000 (FIG. 8). The at least one connecting fluid passage 310 is a variety of ligaments connected to the second area 308 such as, but not limited to, a linking cavity when the second area 308 is an internal fluid path, or a film hole when the second area 308 is a portion of the film hole (e.g., a diffuser or a meter of the film hole formed within the fluid passage wall 302 that the at least one connecting fluid passage 310 extends through).

In the ligament-to-core structure the at least one connecting fluid passage 310 is formed by a core or a portion of a core (e.g., the second core 130 (FIG. 4B), 230 (FIG. 5B)) that is directly coupled to the first area 306 that is defined by a core or a portion of a core (e.g., the first core 128 (FIG. 4B), 228 (FIG. 5B)). The ligament-to-core structure applies to the cast engine component 100 and the casting core 126 (FIGS. 4A and 4B, respectively), the cast engine component 200 and the casting core 226 (FIGS. 5A and 5B, respectively), the cast engine component 800 (FIG. 6) and the cast engine component 1000 (FIG. 8). The at least one connecting fluid passage 310 is a variety of suitable ligaments connected to the first area 306 such as, but not limited to, a linking cavity when the first area 306 is an internal fluid path, or a film hole when the first area 306 is a portion of the film hole (e.g., an internal cavity or a manifold formed within the fluid passage wall 302 that the at least one connecting fluid passage 310 extends through) or when the first area 306 is an internal cavity or passage.

In the core-to-core structure the at least one connecting fluid passage 310 is formed by a core or a portion of a core (e.g., the second core 130 (FIG. 4B)) that is directly coupled to the first area 306 and the second area 308 that are each defined by a core or a portion of a core (e.g., the first core 128). The core-to-ligament structure applies to the cast engine component 100 and the casting core 126 (FIGS. 4A and 4B, respectively), the cast engine component 900 (FIG. 7) and the cast engine component 1000 (FIG. 8). The at least one connecting fluid passage 310 is a variety of ligaments connecting the first area 306 and the second area 308 such as, but not limited to, a linking cavity when the first area 306 is an internal fluid path, or a film hole when the first area 306 and the second area 308 are each a portion of the film or when the first area 306 is an internal cavity or passage.

FIG. 9 illustrates a first geometric boundary 352 useful for quantifying the core-to-ligament structure. The first geometric boundary 352 encompasses the at least one connecting fluid passage 310 and at least a portion of the second area 308 in the immediate vicinity of the at least one connecting fluid passage 310. As used herein, the term "immediate vicinity" is defined as a 2-dimensional polygonal area within a unit of measure of a point of reference. The first geometric boundary 352 is defined by a length ($L_{g1}$) illustrated as the extent of the first geometric boundary 352 in the chordwise direction (Cd), and a height ($Hg_1$) illustrated as the extent of the first geometric boundary 352 in the spanwise direction (Sd). While described in terms of the spanwise direction (Sd), the chordwise direction (Cd), it will be appreciated that the length ($L_{g1}$), or height ($Hg_1$) extend in a variety of directions with respect to the engine centerline 12 (FIG. 1) or the cast engine component 300.

The length ($L_{g1}$) is the total length between the fluid passage wall 302 containing the first distal end 318 and a portion of the outer wall 366 opposite the second distal end 320 in the chordwise direction (Cd). The second distal end 320 is defined by a first fluid path height ($Hf_1$). The height ($Hg_1$) is twice the first fluid path height ($Hf_1$). A midpoint of the height ($Hg_1$) intersects the second centerline 324 at the second distal end 320.

In the first geometric boundary 352, the second area 308 includes a minimum hydraulic diameter ($Dh1_{min}$) that translates to a first minimum equivalent hydraulic diameter ($D1_{eqmin}$) of a portion of the casting core used to form the second area 308. In the first geometric boundary 352, the connecting fluid passage 310 includes a minimum hydraulic diameter ($Dh2_{min}$) that translates to a second minimum equivalent hydraulic diameter ($D2_{eqmin}$) of a portion of the casting core used to form the connecting fluid passage 310.

The first geometric boundary 352 is used to quantify the geometric characteristics in the core-to-ligament structure. TABLE I, below, discloses several embodiments of sizing the first core (e.g. first core 128 (FIG. 4B)) and the second core (e.g. second core 130 (FIG. 4B) of the cast engine component 300. The embodiments in TABLE I illustrate the various geometric characteristics for the core-to-ligament structure that are used when designing an engine component and the casting cores used to form the cast engine component 300.

TABLE I

| Core-to-Ligament | | | | |
|---|---|---|---|---|
| Embodiment | $D1_{eqmin}$ (in) | $D2_{eqmin}$ (in) | $\alpha$/45° | R (in) |
| 1 | 0.015 | 0.03 | 1 | 0.005 |
| 2 | 0.05 | 0.02 | 0.5 | 0.01 |
| 3 | 0.035 | 0.01 | 3 | 0.015 |
| 4 | 0.091 | 0.005 | 3.67 | 0.025 |

FIG. 10 is a schematic cross-sectional view of the cast engine component 300 of FIG. 9, further illustrating a second geometric boundary 354, useful for quantifying a ligament-to-core structure.

The second geometric boundary 354 is defined by the entirety of the at least one connecting fluid passage 310 and the immediate vicinity of the first area 306 in relation to the first distal end 318. The second geometric boundary 354 is defined by a height ($Hg_2$), and a length ($L_{g2}$).

The length ($L_{g2}$) is the total length between the second distal end 320 and the inner wall 304 opposing the first distal end 318. The first distal end 318 is defined by a second fluid path height ($Hf_2$). The height ($Hg_2$) is twice the second fluid path height ($Hf_2$). A midpoint of the height ($Hg_2$) intersects the first centerline 322 at the first distal end 318.

In the second geometric boundary 354, the first area 306 includes a minimum hydraulic diameter ($Dh1_{min}$) that translates to a first minimum equivalent hydraulic diameter ($D1_{eqmin}$) of a portion of the casting core used to form the first area 306. In the second geometric boundary 354, the connecting fluid passage 310 includes a minimum hydraulic diameter ($Dh2_{min}$) that translates to a second minimum equivalent hydraulic diameter ($D2_{eqmin}$) of a portion of the casting core used to form the connecting fluid passage 310.

The second geometric boundary 354 is used to quantify the geometric characteristics in the ligament-to-core structure. TABLE II, below, discloses several embodiments of sizing the first core (e.g. first core 128 (FIG. 4B), 228 (FIG. 5B)) and the second core (e.g. second core 130 (FIG. 4B), 230 (FIG. 5B)) of the cast engine component 300. The embodiments in TABLE II illustrate the various geometric characteristics for the ligament-to-core structure that are used when designing an engine component and the casting cores used to form the cast engine component 300.

TABLE II

| Ligament-to-Core | | | | |
|---|---|---|---|---|
| Embodiment | $D1_{eqmin}$ (in) | $D2_{eqmin}$ (in) | α/45° | R (in) |
| 5 | 0.034 | 0.03 | 1 | 0.005 |
| 6 | 0.1 | 0.02 | 0.5 | 0.01 |
| 7 | 0.3 | 0.01 | 3 | 0.015 |
| 8 | 1 | 0.005 | 3.67 | 0.025 |

FIG. 11 is a schematic cross-sectional view of the cast engine component 300 of FIG. 9, further illustrating a third geometric boundary 356 useful for quantifying a core-to-core structure.

The third geometric boundary 356 is defined by the entirety of the at least one connecting fluid passage 310 and the immediate vicinity of the first area 306 and the second area 308 in relation to the at least one connecting fluid passage 310. The third geometric boundary 356 is defined by the height ($Hg_1$) of the first geometric boundary 352 (FIG. 9) within the second area 308, the height ($Hg_2$) of the second geometric boundary 354 (FIG. 10) within the first area 306, and a length ($L_{g3}$) spanning between the outer wall 366 and the inner wall 304 in the chordwise direction (Cd). It will be appreciated that the height ($Hg_1$) of the first geometric boundary 352 is equal to or non-equal to the height ($Hg_2$) of the second geometric boundary 354.

In the third geometric boundary 356, the first area 306 and the second area 308 each include a minimum hydraulic diameter ($Dh1_{min}$) that are averaged together to define a first minimum equivalent hydraulic diameter ($D1_{eqmin}$) of a portion of the casting core used to form the first area 306 and the second area 308. In the third geometric boundary 356, the connecting fluid passage 310 includes a minimum hydraulic diameter ($Dh2_{min}$) that translates to a second minimum equivalent hydraulic diameter ($D2_{eqmin}$) of a portion of the casting core used to form the connecting fluid passage 310.

The third geometric boundary 356 is used to quantify the geometric characteristics in the core-to-core structure. TABLE III, below, discloses several embodiments of sizing the first core (e.g., the first core 128 (FIG. 4B)) and the second core (e.g., the second core 130 (FIG. 4B)) of the cast engine component 300. The embodiments in TABLE II illustrate the various geometric characteristics for the core-to-core structure that are used when designing an engine component and the casting cores used to form the cast engine component 300.

TABLE III

| Core-to-Core | | | | |
|---|---|---|---|---|
| Embodiment | $D1_{eqmin}$ (in) | $D2_{eqmin}$ (in) | α/45° | R (in) |
| 9 | 0.017 | 0.06 | 1 | 0.005 |
| 10 | 0.1 | 0.02 | 0.5 | 0.01 |
| 11 | 0.7 | 0.2 | 3 | 0.035 |
| 12 | 1 | 0.01 | 3.67 | 0.05 |

FIGS. 12-15 each describe various complex geometries for a respective connecting fluid passage. It will be appreciated that FIGS. 10-13 are non-limiting examples of the complex architecture. While described in terms of a cast engine component, it will be appreciated that the complex architecture described in FIGS. 10-13 are manufactured through use of a casting core having at least one core, as described herein.

Figure 12:
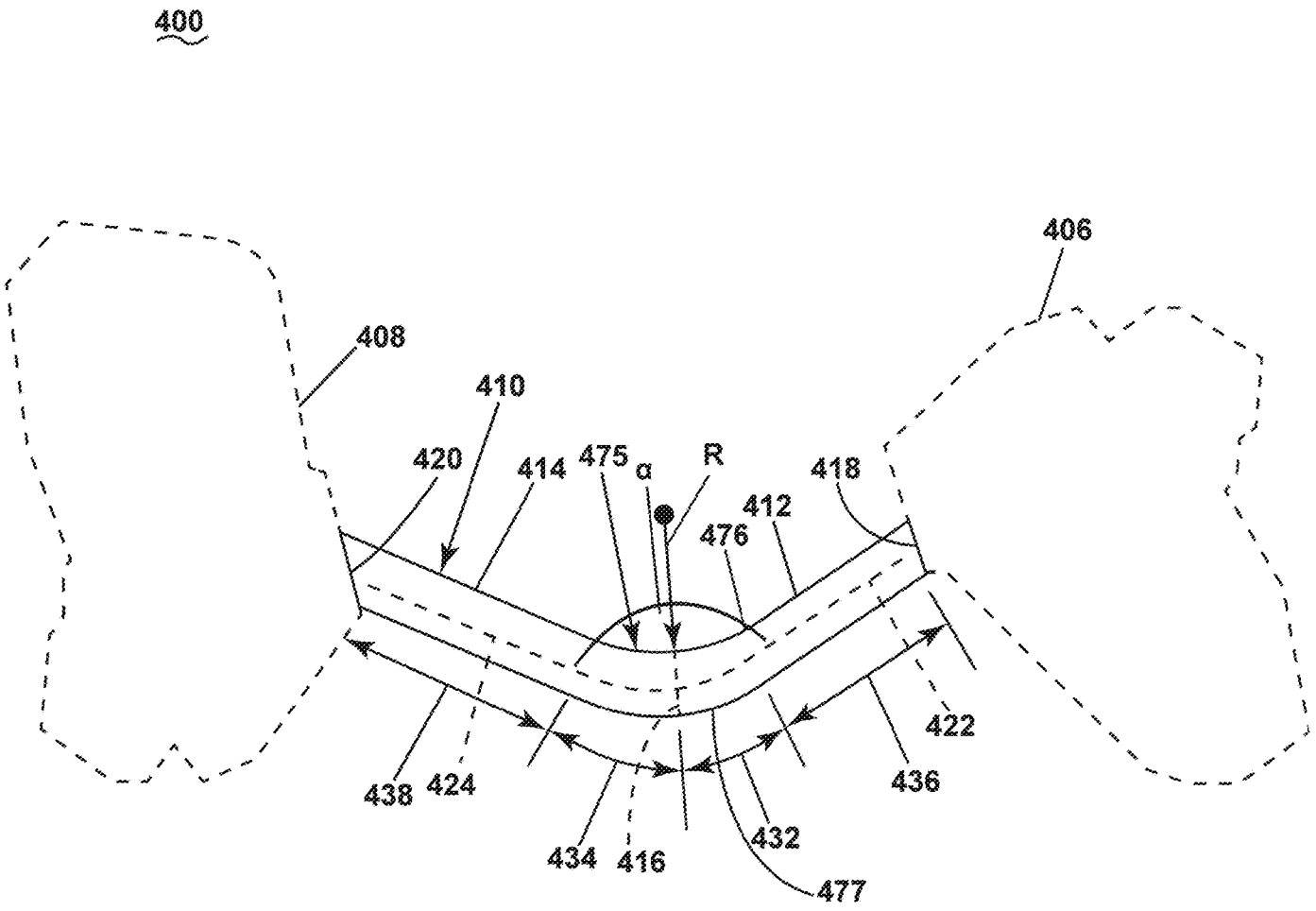
FIG. 12 is a schematic cross-sectional representation of an exemplary cast engine component suitable for use within the turbine engine of FIG. 1, the exemplary cast engine component including a uniform connecting fluid passage extending between a first area and a second area.

FIG. 12 is a schematic cross-sectional representation of an exemplary cast engine component 400 suitable for use within the turbine engine 10 of FIG. 1. The cast engine component 400 is similar to the cast engine component 100, 200, 300, 800, 900, 1000, therefore, like parts will be identified with like numerals increased to the 400 series, with it being understood that the description of the like parts of the cast engine component 100, 200, 300, 800, 900, 1000 applies to the cast engine component 400 unless otherwise noted.

The cast engine component 400 includes a first area 406 and a second area 408, with at least one connecting fluid passage 410 extending therebetween. The at least one connecting fluid passage 410 extends between a first distal end 418 and a second distal end 420. The at least one connecting fluid passage 410 includes a first leg 412 having a first centerline 422 and a second leg 414 having a second centerline 424. The first leg 412 intersects with the second leg 414 at an intersection 416. An angle (α) is formed at the intersection 416 between the first centerline 422 and the second centerline 424. A turn 475 having a first bend 476 and a second bend 477 is formed between the first leg 412 and the second leg 414. Both the first bend 476 and the second bend 477 include a respective radius of curvature, with a smaller of the two radii defining a radius (R) of the turn 475. The first leg 412 extends between the intersection 416 and the first distal end 418. The second leg 414 extends between the intersection 416 and the second distal end 420. The first area 406 is an interior portion of the cast engine component 400. The second area is an interior portion of the cast engine component 400 or a portion exterior the cast engine component 400.

The at least one connecting fluid passage 410 includes a first region 432 of the first leg 412, a second region 434 of the second leg 414, a third region 436 of the first leg 412, and a fourth region 438 of the second leg 414. The first region 432 and the second region 434 are equal or non-equal in length (denoted by the respective arrows). The third region 436 and the fourth region 438 are equal or non-equal in length (denoted by the respective arrows).

The at least one connecting fluid passage 410 includes at least one linear section. The third region 436 and the fourth region 438 each extend linearly from the first region 432 and the second region 434, respectively, and to the first distal end 418 and the second distal end 420, respectively. At least a portion of the connecting fluid passage 410 includes at least one non-linear section. The first region 432 and the second region 434 each include a respective portion of the turn 475.

The first area 406 and the second area 408 are both shown in phantom lines. As such, the first area 406 and the second area are a variety of suitable shapes or sizes. The first area 406 or the second area 408 are continuous (e.g., fully enclosed) or non-continuous or otherwise non-solid. The first area 406 or the second area 408 include a variety of features such as holes (e.g., cooling holes, connecting fluid passages, or additional walls) that are formed along the exterior of or within the interior of the respective first area 406 or the second area 408.

Figure 13:
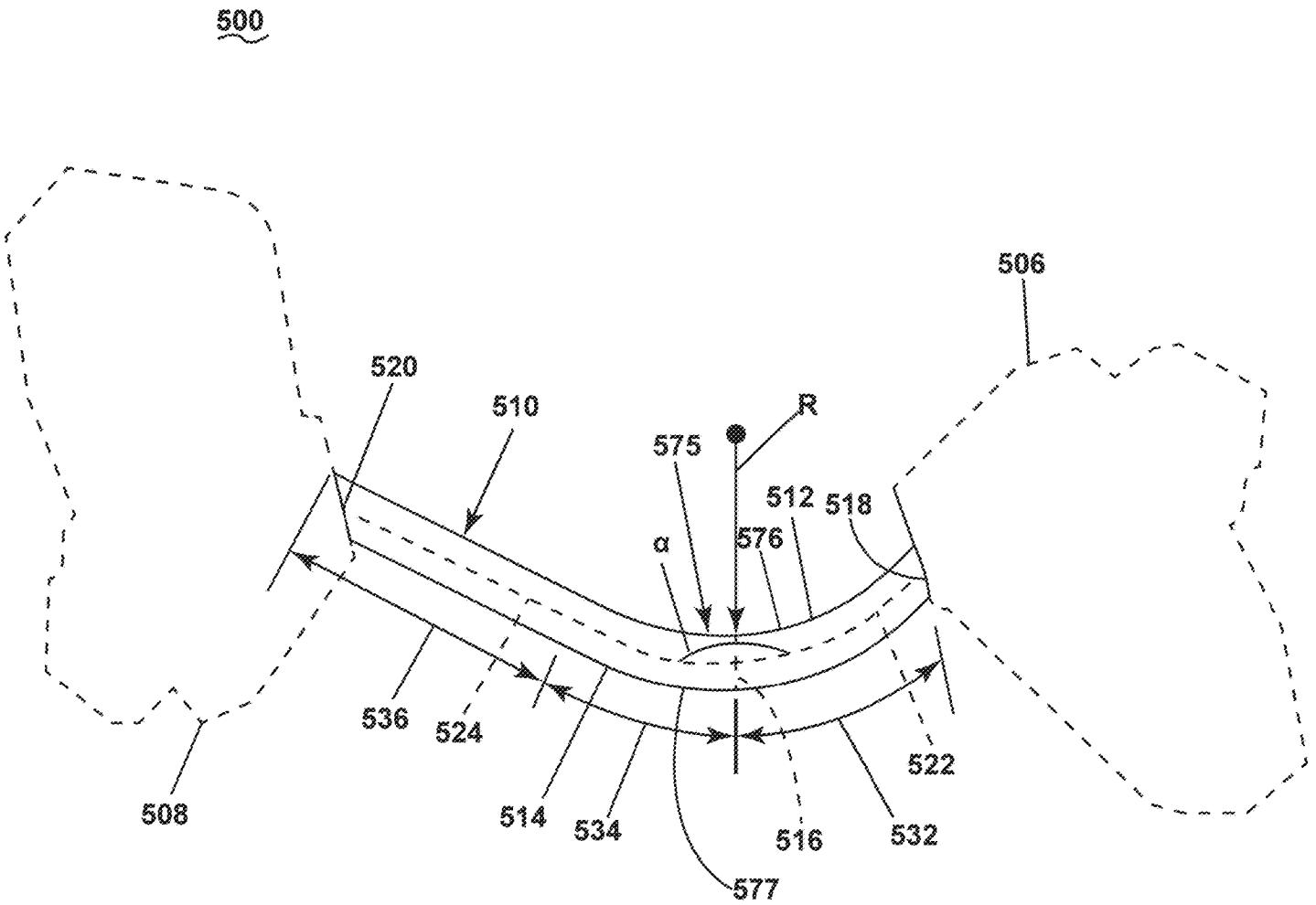
FIG. 13 is a schematic cross-sectional representation of an exemplary cast engine component suitable for use within the turbine engine of FIG. 1, the exemplary cast engine component including a non-uniform connecting fluid passage extending between a first area and a second area.

FIG. 13 is a schematic cross-sectional representation of an exemplary cast engine component 500 suitable for use within the turbine engine 10 of FIG. 1. The cast engine component 500 is similar to the cast engine component 100, 200, 300, 400, 800, 900, 1000, therefore, like parts will be identified with like numerals increased to the 500 series, with it being understood that the description of the like parts of the cast engine component 100, 200, 300, 400, 800, 900, 1000 applies to the cast engine component 500 unless otherwise noted.

The cast engine component 500 includes a first area 506 and a second area 508, with at least one connecting fluid passage 510 extending therebetween. The at least one connecting fluid passage 510 extends between a first distal end 518 and a second distal end 520. The at least one connecting fluid passage 510 includes a first leg 512 having a first centerline 522 and a second leg 514 having a second centerline 524. The first leg 512 intersects with the second leg 514 at an intersection 516. An angle ($\alpha$) is formed at the intersection 516 between the first centerline 522 and the second centerline 524. A turn 575 having a first bend 576 and a second bend 577 is formed between the first leg 512 and the second leg 514. Both the first bend 576 and the second bend 577 include a respective radius of curvature, with a smaller of the two radius of curvatures defining a radius (R) of the turn 575. The first leg 512 extends between the intersection 516 and the first distal end 518. The second leg 514 extends between the intersection 516 and the second distal end 520. The first area 506 is an interior portion of the cast engine component 500. The second area is an interior portion of the cast engine component 500 or a portion exterior the cast engine component 500.

Similar to the at least one connecting fluid passage 410 of FIG. 12, the at least one connecting fluid passage 510 includes the first leg 512 and the second leg 514 including a first region 532 and a second region 534, respectively. The first region 532 and the second region 534 are each non-linear and are defined by a respective portion of the turn 575. The at least one connecting fluid passage 510, however, includes a single linear region (e.g., a third region 536) rather than two linear regions. As such, the turn 575 extends continuously from the intersection 516 to the first distal end 518.

Figure 14:
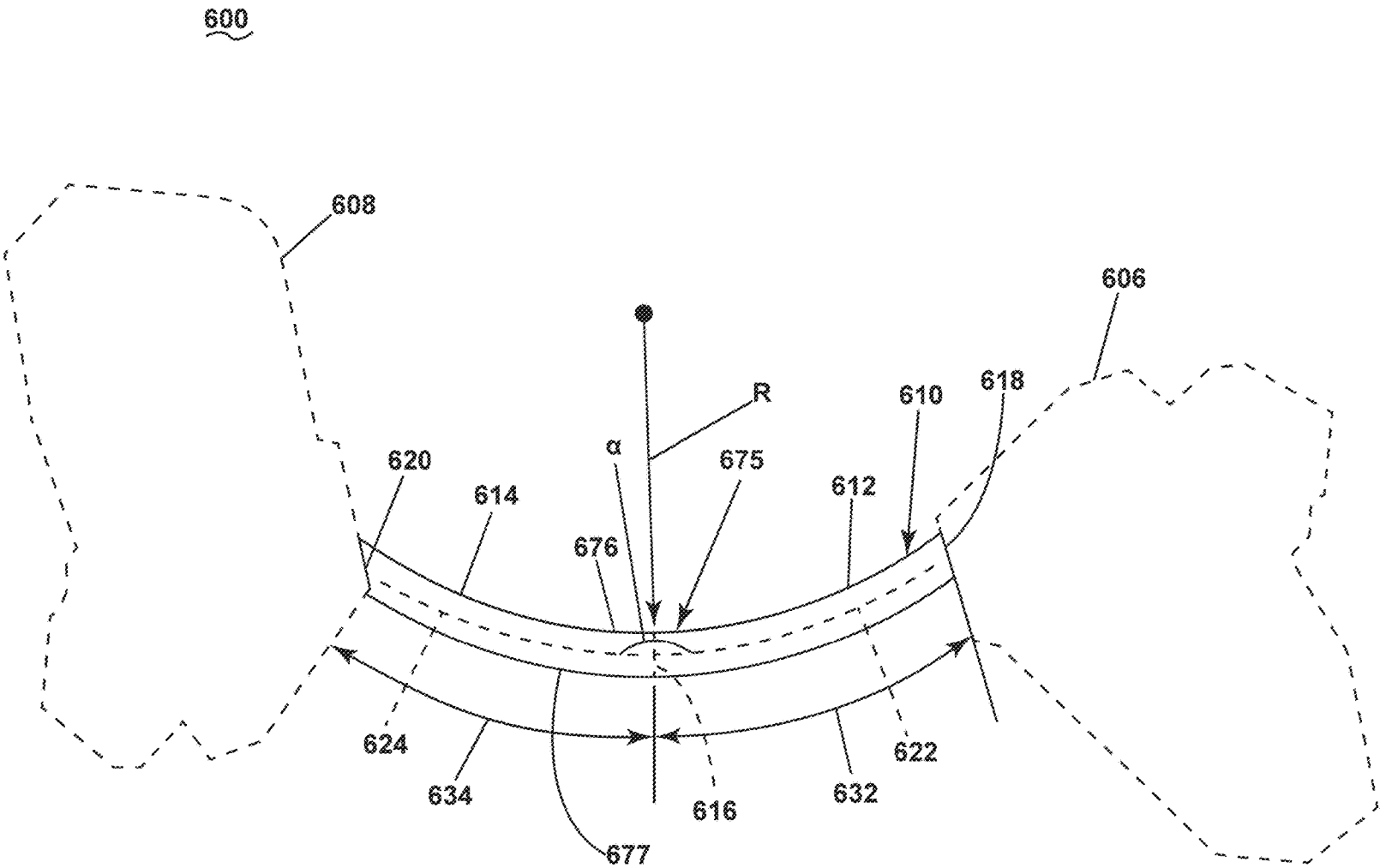
FIG. 14 is a schematic cross-sectional representation of an exemplary cast engine component suitable for use within the turbine engine of FIG. 1, the exemplary cast engine component including a connecting fluid passage defined by a bend over an entirety of the connecting fluid passage extending between a first area and a second area.

FIG. 14 is a schematic cross-sectional representation of an exemplary cast engine component 600 suitable for use within the turbine engine of FIG. 1. The cast engine component 600 is similar to the cast engine component 100, 200, 300, 400, 500, 800, 900, 1000, therefore, like parts will be identified with like numerals increased to the 600 series, with it being understood that the description of the like parts of the cast engine component 100, 200, 300, 400, 500, 800, 900, 1000 applies to the cast engine component 600 unless otherwise noted.

The cast engine component 600 includes a first area 606 and a second area 608, with at least one connecting fluid passage 610 extending therebetween. The at least one connecting fluid passage 610 extends between a first distal end 618 and the second distal end 620. The at least one connecting fluid passage 610 includes a first leg 612 having a first centerline 622 and a second leg 614 having a second centerline 624. The first leg 612 intersects with the second leg 614 at an intersection 616. An angle ($\alpha$) is formed at the intersection 616 between the first centerline 622 and the second centerline 624. A turn 675 having a first bend 676 and a second bend 677 is formed between the first leg 612 and the second leg 614. Both the first bend 676 and the second bend 677 include a respective radius of curvature, with a smaller of the two radius of curvatures defining a radius (R) of the turn 675. The first leg 612 extends between the intersection 616 and the first distal end 618. The second leg 614 extends between the intersection 616 and the second distal end 620. The first area 606 is an interior portion of the cast engine component 600. The second area is an interior portion of the cast engine component 600 or a portion exterior the cast engine component 600.

Similar to the at least one connecting fluid passage 410, 510 of FIGS. 12 and 13, respectively, the at least one connecting fluid passage 610 includes the first leg 612 and the second leg 614 including a first region 632 and the second region 634, respectively. The first region 632 and the second region 634 are each non-linear and are defined by a respective portion of the turn 675. The at least one connecting fluid passage 610, however, does not include a linear region. In other words, the turn 675 defines an entire length of the at least one connecting fluid passage 610 such that the turn 675 extends continuously between the first distal end 618 and the second distal end 620. The at least one connecting fluid passage 610 is symmetric or non-symmetric about the intersection 616.

Figure 15:
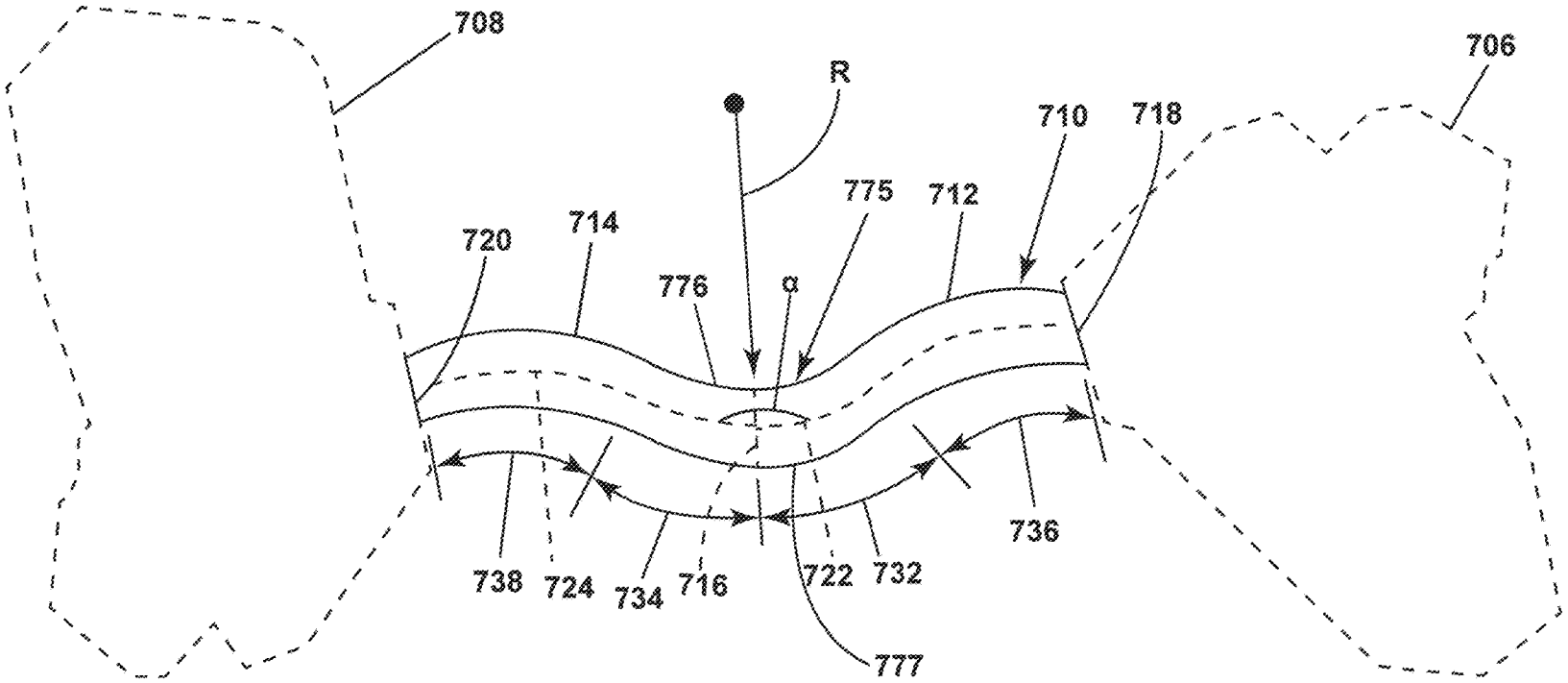
FIG. 15 is a schematic cross-sectional representation of an exemplary cast engine component suitable for use within the turbine engine of FIG. 1, the exemplary cast engine component including a serpentine connecting fluid passage extending between a first area and a second area.

FIG. 15 is a schematic cross-sectional representation of an exemplary cast engine component suitable for use within the turbine engine of FIG. 1. The cast engine component 700 is similar to the cast engine component 100, 200, 300, 400, 500, 600, 800, 900, 1000, therefore, like parts will be identified with like numerals increased to the 700 series, with it being understood that the description of the like parts of the cast engine component 100, 200, 300, 400, 500, 600, 800, 900, 1000 applies to the cast engine component 700 unless otherwise noted.

The cast engine component 700 includes a first area 706 and a second area 708, with at least one connecting fluid passage 710 extending therebetween. The at least one connecting fluid passage 710 extends between a first distal end 718 and a second distal end 720. The at least one connecting fluid passage 710 includes a first leg 712 having a first centerline 722 and a second leg 714 having a second centerline 724. The first leg 712 intersects with the second leg 714 at an intersection 716. An angle (α) is formed at the intersection 716 between the first centerline 722 and the second centerline 724. A turn 775 having a first bend 776 and a second bend 777 is formed between the first leg 712 and the second leg 714. Both the first bend 776 and the second bend 777 include a respective radius of curvature, with a smaller of the two radius of curvatures defining a radius (R) of the turn 775. The first leg 712 extends between the intersection 716 and the first distal end 718. The second leg 714 extends between the intersection 716 and the second distal end 720. The first area 706 is an interior portion of the cast engine component 700. The second area is an interior portion of the cast engine component 700 or a portion exterior the cast engine component 700.

Similar to the at least one connecting fluid passage 410 of FIG. 12, the at least one connecting fluid passage 710 includes the first leg 712 including a first region 732 and the second leg 714 including a second region 734 that are non-linear and defined by a respective portion of the turn 775. In the embodiment of FIG. 15, the at least one connecting fluid passage 710, however, includes a third region 736 and a fourth region 738 that are each non-linear, but not defined by the turn 775. The at least one connecting fluid passage 710, as illustrated, forms an undulating or wave formation. It will be appreciated, however, that the third region 736 and the fourth region 738 take a variety of suitable non-linear formation.

The benefits associated with the varied formation of the at least one connecting fluid passage 410, 510, 610, 710 described in FIGS. 12-15 is that further turning of the flow characteristics to achieve the component objectives of the finished cast engine component 400, 500, 600, 700 while still achieving the manufacturability of the cast engine component 400, 500, 600, 700 is achieved. In other words, the connecting fluid passage 410, 510, 610, 710 achieves or satisfies the flow characteristics of the cast engine component and are able to be manufactured through use of the casting cores. Changing the formation of the at least one connecting fluid passage 410, 510, 610, 710 results in the ability to tune where the fluid within the at least one connecting fluid passage 410, 510, 610, 710 flows through within the cast engine component 400, 500, 600, 700. Using an undulating pattern (e.g., FIG. 15) allows for a larger surface area of the at least one connecting fluid passage 410, 510, 610, 710 in comparison to a linear connecting fluid passage. If the at least one connecting fluid passage 410, 510, 610, 710 is a cooling hole, this would, in turn, increase the cooling effectiveness of the at least one connecting fluid passage 410, 510, 610, 710 by maximizing the total area of the cast engine component 400, 500, 600, 700 that the at least one connecting fluid passage 410, 510, 610, 710 extends over or through.

As previously discussed, the production and designing of a casting core that results in a cast engine component with complex geometry is very difficult when casting and has historically been done through a trial-by-error or otherwise iterative process. This process is prone to fail as there are multiple factors to consider when forming a cast engine component. If, for example, the geometry of the casting core that defines the complex feature is too rigid or thick, the casting core will be prone to break when being formed (e.g., during firing of a ceramic core) or during the actual casting process. If the geometry of the casting core that defines the complex geometry of the cast engine component is too stiff, grains are created in the final cast engine component, which ultimately reduce the mechanical strength of the cast engine component (e.g., create a failure point of the cast engine component). If the geometry of the casting core results in a casting core that is too weak (e.g., not sufficiently stiff), the casting core will move around or break during manufacture. This, in turn, results in at least some of the complex features not being fully formed or otherwise improperly formed, which ultimately results in the final cast engine component not being formed as intended, thus failing to meet the component objectives.

During the development of the previously described embodiments, the inventors discovered a relationship between certain geometric characteristics of the casting core that would lead to a casting core that could be cast without having the complex geometry being too thick or too thin, which would ensure that the casting core and the cast engine component would satisfy the desired objectives. The relationship between the certain geometric characteristics would permit the casting of complex connecting fluid passages within the component, while still ensuring the casting core would not break during casting or formation.

The relationship essentially finds a balance between the first minimum equivalent diameter ($D1_{eqmin}$), the second minimum equivalent diameter ($D2_{eqmin}$), the radius (R), and the angle (α), which will ensure that casting is possible while enabling the inventors to select values for the geometric characteristics that will yield a properly functioning component. This, in turn, eliminates the time-consuming and expensive iterative process for designing such components.

The inventors have found the relationships between the first minimum equivalent diameter ($D1_{eqmin}$), the second minimum equivalent diameter ($D2_{eqmin}$), the radius (R), and the angle (α) that result in a casting core that satisfies design objectives and the flow characteristics of the cast engine component. Referred to herein as the flexible geometry factor (FGF), these relationships were an unexpected discovery during the course of engine design—i.e., designing cores that results in a cast engine component that is able to be manufactured and satisfies the component objectives.

A first flexible geometry factor (FGF1) is defined by the following:

$$FGF1 = \left(\frac{D1_{eqmin}}{D2_{eqmin}}\right)\left(\frac{R}{D2_{eqmin}}\right) \tag{1}$$

In the core-to-ligament structure, the first flexible geometry factor (FGF1) is greater than or equal to 0.08 and less than or equal to 100 ($0.08 \leq FGF1 \leq 100$). In the ligament-to-core structure, the first flexible geometry factor (FGF1) is greater than or equal to 0.19 and less than or equal to 1000 ($0.19 \leq FGF1 \leq 1000$). In the core-to-core structure, the first flexible geometry factor (FGF1) is greater than or equal to 0.02 and less than or equal to 500 ($0.02 \leq FGF1 \leq 500$).

In summary, TABLE IV illustrates the first flexible geometry factor (FGF1) using the parameters outlined in TABLES I, II, and III previously. For ease of reference, the ligament-to-core, core-to-ligament, and core-to-core structures are identified in TABLE IV.

TABLE IV

| | Embodiment | $D1_{eqmin}$ (in) | $D2_{eqmin}$ (in) | α/45° | R (in) | FGF1 |
|---|---|---|---|---|---|---|
| Core-to-Ligament | 1 | 0.015 | 0.03 | 1 | 0.005 | 0.083 |
| | 2 | 0.05 | 0.02 | 0.5 | 0.01 | 1.25 |
| | 3 | 0.035 | 0.01 | 3 | 0.015 | 5.25 |
| | 4 | 0.091 | 0.005 | 3.67 | 0.025 | 90.909 |
| Ligament-to-Core | 5 | 0.034 | 0.03 | 1 | 0.005 | 0.191 |
| | 6 | 0.1 | 0.02 | 0.5 | 0.01 | 2.5 |
| | 7 | 0.3 | 0.01 | 3 | 0.015 | 45 |
| | 8 | 1 | 0.005 | 3.67 | 0.025 | 1000 |
| Core-to- | 9 | 0.017 | 0.06 | 1 | 0.005 | 0.024 |

TABLE IV-continued

| | Embodiment | $D1_{eqmin}$ (in) | $D2_{eqmin}$ (in) | α/45° | R (in) | FGF1 |
|---|---|---|---|---|---|---|
| Core | 10 | 0.1 | 0.02 | 0.5 | 0.01 | 2.5 |
| | 11 | 0.7 | 0.2 | 3 | 0.035 | 0.61 |
| | 12 | 1 | 0.01 | 3.67 | 0.05 | 500 |

A second flexible geometry factor (FGF2) is defined by the following:

$$FGF2 = \left(\frac{D1_{eqmin}}{D2_{eqmin}}\right)\left(\frac{R}{D2_{eqmin}}\right)\left(\frac{\alpha}{45°}\right) \tag{2}$$

In the core-to-ligament structure, the second flexible geometry factor (FGF2) is greater than or equal to 0.08 and less than or equal to 400 (0.08≤FGF2≤400). In the ligament-to-core structure, the second flexible geometry factor (FGF2) is greater than or equal to 0.19 and less than or equal to 4000 (0.19≤FGF2≤4000). In the core-to-core structure, the second flexible geometry factor (FGF2) is greater than or equal to 0.02 and less than or equal to 2000 (0.02≤FGF2≤2000).

In summary, TABLE V illustrates the second flexible geometry factor (FGF2) using the parameters outlined in TABLES I, II, and III previously. For ease of reference, the ligament-to-core, core-to-ligament, and core-to-core structures are identified in TABLE V.

TABLE V

| | Embodiment | $D1_{eqmin}$ (in) | $D2_{eqmin}$ (in) | α/45° | R (in) | FGF2 |
|---|---|---|---|---|---|---|
| Core-to-Ligament | 1 | 0.015 | 0.03 | 1 | 0.005 | 0.083 |
| | 2 | 0.05 | 0.02 | 0.5 | 0.01 | 0.625 |
| | 3 | 0.035 | 0.01 | 3 | 0.015 | 15.75 |
| | 4 | 0.091 | 0.005 | 3.67 | 0.025 | 333.636 |
| Ligament-to-Core | 5 | 0.034 | 0.03 | 1 | 0.005 | 0.191 |
| | 6 | 0.1 | 0.02 | 0.5 | 0.01 | 1.25 |
| | 7 | 0.3 | 0.01 | 3 | 0.015 | 135 |
| | 8 | 1 | 0.005 | 3.67 | 0.025 | 3670 |
| Core-to-Core | 9 | 0.017 | 0.06 | 1 | 0.005 | 0.024 |
| | 10 | 0.1 | 0.02 | 0.5 | 0.01 | 1.25 |
| | 11 | 0.7 | 0.2 | 3 | 0.035 | 1.84 |
| | 12 | 1 | 0.01 | 3.67 | 0.05 | 1835 |

A third flexible geometry factor (FGF3) is defined by the following:

$$FGF3 = \left(\frac{D1_{eqmin}}{D2_{eqmin}}\right) \tag{3}$$

In the core-to-ligament structure, the third flexible geometry factor (FGF3) is greater than or equal to 0.5 and less than or equal to 19 (0.5≤FGF3≤19). In the ligament-to-core structure, the third flexible geometry factor (FGF3) is greater than or equal to 1 and less than or equal to 200 (1≤FGF3≤200). In the core-to-core structure, the third flexible geometry factor (FGF3) is greater than or equal to 0.2 and less than or equal to 100 (0.2≤FGF3≤100).

In summary, TABLE VI illustrates the third flexible geometry factor (FGF3) using the parameters outlined in TABLES I, II, and III previously. For ease of reference, the ligament-to-core, core-to-ligament, and core-to-core structures are identified in TABLE VI.

TABLE VI

| | Embodiment | $D1_{eqmin}$ (in) | $D2_{eqmin}$ (in) | α/45° | R (in) | FGF3 |
|---|---|---|---|---|---|---|
| Core-to-Ligament | 1 | 0.015 | 0.03 | 1 | 0.005 | 0.5 |
| | 2 | 0.05 | 0.02 | 0.5 | 0.01 | 2.5 |
| | 3 | 0.035 | 0.01 | 3 | 0.015 | 3.5 |
| | 4 | 0.091 | 0.005 | 3.67 | 0.025 | 18.182 |
| Ligament-to-Core | 5 | 0.034 | 0.03 | 1 | 0.005 | 1.143 |
| | 6 | 0.1 | 0.02 | 0.5 | 0.01 | 5 |
| | 7 | 0.3 | 0.01 | 3 | 0.015 | 30 |
| | 8 | 1 | 0.005 | 3.67 | 0.025 | 200 |
| Core-to-Core | 9 | 0.017 | 0.06 | 1 | 0.005 | 0.286 |
| | 10 | 0.1 | 0.02 | 0.5 | 0.01 | 5 |
| | 11 | 0.7 | 0.2 | 3 | 0.035 | 3.5 |
| | 12 | 1 | 0.01 | 3.67 | 0.05 | 100 |

Generally speaking, in all cases the first flexible geometry factor (FGF1) is greater than or equal to 0.02 and less than or equal to 1000 (0.02≤FGF1≤1000). In all cases, the second flexible geometry factor (FGF2) is greater than or equal to 0.02 and less than or equal to 4000 (0.02≤FGF2≤4000). The third flexible geometry (FGF3) is greater than or equal to 0.5 and less than or equal to 50 (0.2≤FGF3≤200).

The first flexible geometry factor (FGF1), the second flexible geometry factor (FGF2) and the third flexible geometry factor (FGF3), are used together or individually, during the design process and manufacturing process (e.g., casting) to determine the geometric characteristics of the casting core that form the cast engine component and the complex features of the casting core. The first flexible geometry factor (FGF1), the second flexible geometry factor (FGF2) and the third flexible geometry factor (FGF3) are used in relation to the first geometric boundary, the second geometric boundary and the third geometric boundary to ensure that the geometric characteristics satisfy the above-described ranges within areas that are prone to break during casting do not break or form poorly.

Further, it will be appreciated that the first flexible geometry factor (FGF1), the second flexible geometry factor (FGF2) and the third flexible geometry factor (FGF3) are used to determine the hydraulic diameters for the finished cast engine component, and ultimately ensure that the geometric characteristics of the casting cores used in manufacturing result in an engine component satisfy the flow characteristics of the cast engine component. When a casting core is designed to fit within the ranges described above, the casting core is designed in an advantageous space where it has the needed balance with rigidity or stiffness. For example, if the casting core were designed outside of the above-described ranges, the casting core will end up being overly stiff or not sufficiently stiff. This, in turn, results in the casting core being susceptible to breaking or cracking in the case of the former, or not forming in the shape as intended in the case of the latter. The first flexible geometry factor (FGF1), the second flexible geometry factor (FGF2) and the third flexible geometry factor (FGF3), along with the ranges described above, greatly reduce the burden of manufacturing by ensuring that the casting cores used to manufacture the cast engine component will always result in the cast engine component being able to be manufactured and satisfy component objectives.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A casting core used in the manufacture of a cast engine component for a turbine engine, the cast engine component having a first area, a second area, a fluid passage wall separating the first area and the second area, and a connecting fluid passage extending through the fluid passage wall and interconnecting the first area and the second area, the casting core comprising a first core corresponding to at least one of the first area or the second area of the cast engine component, and a second core corresponding to the connecting fluid passage of the cast engine component, the second core further defining a first leg of the connecting fluid passage extending in a first direction, a second leg of the connecting fluid passage extending in a second direction non-parallel to the first direction, the second leg intersecting the first leg at an angle ($\alpha$), and a turn of the connecting fluid passage formed along an intersection between the first leg and the second leg and extending along at least a portion of the first leg or the second leg, the turn having a first bend with a first radius of curvature and a second bend with a second radius of curvature, with the smallest of the first and second radius of curvature defining a radius (R) of the turn wherein after a casting process, the first core and the second core are each removed to define voids formed within the cast engine component wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of at least one of the first area or the second area within the geometric boundary, and a second minimum equivalent diameter ($D2_{eqmin}$) of second core that is representative of a minimum hydraulic diameter of the connecting fluid passage within the geometric boundary, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A casting core used in the manufacture of a cast component having a first area, a second area, a fluid passage wall separating the first area and the second area, and a connecting fluid passage extending through the fluid passage wall and interconnecting the first area and the second area, the casting core comprising a first core corresponding to at least one of the first area or the second area of the cast engine component, and a second core corresponding to the connecting fluid passage of the cast engine component, the second core further defining a first leg of the connecting fluid passage extending in a first direction, a second leg of the connecting fluid passage extending in a second direction non-parallel to the first direction, the second leg intersecting the first leg at an angle ($\alpha$), and a turn of the connecting fluid passage formed along an intersection between the first leg and the second leg and extending along at least a portion of the first leg or the second leg, the turn having a first bend with a first radius of curvature and a second bend with a second radius of curvature, with the smallest of the first and second radius of curvature defining a radius (R) of the turn, wherein after a casting process, the first core and the second core are each removed to define voids formed within the cast engine component, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of at least one of the first area or the second area within the geometric boundary, and a second minimum equivalent diameter ($D2_{eqmin}$) of second core that is representative of a minimum hydraulic diameter of the connecting fluid passage within the geometric boundary, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast engine component comprising a fluid passage wall separating a first area and a second area, and at least one connecting fluid passage extending through the fluid passage wall and fluidly coupling the first area to the second area, the at least one connecting fluid passage extending between a first distal end directly fluidly confronting the first area and a second distal end directly fluidly confronting the second area, the at least one connecting fluid passage comprising a first leg extending in a first direction and having a first centerline, the first leg meeting the first area at a first intersection, with a first angle ($\sigma_1$) being formed between the first centerline and a first plane parallel to the first intersection, and a second leg extending in a second direction non-parallel to the first direction and having a second centerline, the second leg meeting the second area at a second intersection, with a second angle ($\sigma_2$) being formed between the second centerline and a second plane parallel to the second intersection, wherein both the first angle ($\sigma_1$) and the second angle ($\sigma_2$) are greater than or equal to 15 degrees and less than or equal to 165 degrees (15 degrees$\leq\sigma\leq$165 degrees).

A cast component comprising a fluid passage wall separating a first area and a second area, and at least one connecting fluid passage extending through the fluid passage wall and fluidly coupling the first area to the second area, the at least one connecting fluid passage extending between a first distal end directly fluidly confronting the first area and a second distal end directly fluidly confronting the second area, the at least one connecting fluid passage comprising a first leg extending in a first direction and having a first centerline, the first leg meeting the first area at a first intersection, with a first angle ($\sigma_1$) being formed between the first centerline and a first plane parallel to the first intersection, and a second leg extending in a second direction non-parallel to the first direction and having a second centerline, the second leg meeting the second area at a second intersection, with a second angle ($\sigma_2$) being formed between the second centerline and a second plane parallel to the second intersection wherein both the first angle ($\sigma_1$) and the second angle ($\sigma_2$) are greater than or equal to 15 degrees and less than or equal to 165 degrees (15 degrees≤σ≤165 degrees).

A cast engine component for a turbine engine, the cast engine component comprising a fluid passage wall separating a first area and a second area, and a plurality of connecting fluid passages, with each connecting fluid passage extending through a respective portion of the fluid passage wall and fluidly coupling a respective portion of the first area to a respective portion of the second area, each connecting fluid passage extending between a first distal end directly fluidly confronting the first area and a second distal end directly fluidly confronting the second area, each connecting fluid passage comprising a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein during a casting process, the first area and the second area are each defined by a first core and each connecting fluid passage is defined by a second core, wherein a portion of the first core and the second core within a geometric boundary including one connecting fluid passage of the plurality of connecting fluid passages and at least a portion of the first area or the second area is defined by a set of geometric characteristics of the one connecting fluid passage and at least one of the first area or the second area, the set of geometric characteristics having a first minimum equivalent diameter ($D1_{eqmin}$) of at least one of the first area or the second area, and a second minimum equivalent diameter ($D2_{eqmin}$) of the one connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 (0.02≤FGF1≤1000).

A cast component comprising a fluid passage wall separating a first area and a second area, and a plurality of connecting fluid passages, with each connecting fluid passage extending through a respective portion of the fluid passage wall and fluidly coupling a respective portion of the first area to a respective portion of the second area, each connecting fluid passage extending between a first distal end directly fluidly confronting the first area and a second distal end directly fluidly confronting the second area, each connecting fluid passage comprising a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein during a casting process, the first area and the second area are each defined by a first core and each connecting fluid passage is defined by a second core, wherein a portion of the first core and the second core within a geometric boundary including one connecting fluid passage of the plurality of connecting fluid passages and at least a portion of the first area or the second area is defined by a set of geometric characteristics of the one connecting fluid passage and at least one of the first area or the second area, the set of geometric characteristics having a first minimum equivalent diameter ($D1_{eqmin}$) of at least one of the first area or the second area, and a second minimum equivalent diameter ($D2_{eqmin}$) of the one connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 (0.02≤FGF1≤1000).

A cast engine component for a turbine engine, the cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the second core is removed to define a film hole interconnecting the first area and the second area and the first core is removed from the cast component to define a portion of the film hole, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 (0.02≤FGF1≤1000).

A cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises, a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the second core is removed to define a film hole interconnecting the first area and the second area and the first core is removed from the cast component to define a portion of the film hole, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast component comprising a fluid passage wall separating a first area and a second area, a first core defining at least a portion of the first area or the second area, a second core extending through the fluid passage wall between a first distal end confronting the first area and a second distal end confronting the second area and having a refractory metal, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast engine component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having, a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast component comprising a fluid passage wall separating a first area and a second area, a first core defining at least a portion of the first area or the second area, a second core extending through the fluid passage wall between a first distal end confronting the first area and a second distal end confronting the second area and having a refractory metal, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having, a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast component comprising a fluid passage wall separating a first area and a second area, a continuous core defining at least a portion of the first area or the second area, and third area extending through the fluid passage wall between a first distal end confronting the first area and a second distal end confronting the second area and having a refractory metal, wherein the third area comprises a first leg extending in a first direction, a second leg extending in a second direction non-parallel to the first direction, the second leg intersecting the first leg at an angle ($\alpha$), a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the continuous core is removed from the cast component to define at least one connecting fluid passage and a connecting fluid passage interconnecting the first area and the second area, wherein at least a portion of continuous core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast component comprising a fluid passage wall separating a first area and a second area, a continuous core defining at least a portion of the first area or the second area, and third area extending through the fluid passage wall between a first distal end confronting the first area and a second distal end confronting the second area and having a refractory metal, wherein the third area comprises, a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the continuous core is removed from the cast component to define at least one connecting fluid passage and a connecting fluid passage interconnecting the first area and the second area, wherein at least a portion of continuous core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast component comprising, a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein at least a portion of the first leg and the second leg extend non-linearly between the first distal end and the second distal end, wherein after a casting process, the first core is removed from the cast engine component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine having a rotational axis, the cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein the first direction and the second direction include at least two axis, with respect to the rotational axis, that are non-parallel, wherein after a casting process, the first core is removed from the cast engine component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein the first direction and the second direction include at least two axis that are non-parallel, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast airfoil for a turbine engine, the cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast airfoil to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having, a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast airfoil comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage wherein a first flexible geometry factor (FGF1) is equal to:

$$\left(\frac{D1_{eqmin}}{D2_{eqmin}}\right)\left(\frac{R}{D2_{eqmin}}\right),$$

wherein the first flexible geometry factor (FGF1) is greater than or equal to 0.02 and less than or equal to 1000 ($0.02 \leq FGF1 \leq 1000$).

A cast heat exchanger for a turbine engine, the cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises, a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast heat exchanger to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast heat exchanger comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg extending in a first direction, a second leg extending in a second direction non-parallel to the first direction, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast component comprising, a fluid passage wall separating a first area and a second area, a first core defining at least a portion of the first area or the second area, a second core extending through the fluid passage wall between a first distal end confronting the first area and a second distal end confronting the second area, wherein the second core comprises a first leg having a first centerline extending in a first direction and having a first cross-sectional area when viewed along a plane normal to the first centerline and intersecting the first leg, a second leg having a second centerline extending in a second direction non-parallel to the first direction and having a second cross-sectional area when viewed along a plane normal to the second centerline and intersecting the second leg, the second leg intersecting the first leg at an angle (α), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast engine component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises, a first leg having a first centerline extending in a first direction and having a first cross-sectional area when viewed along a plane normal to the first centerline and intersecting the first leg, a second leg having a second centerline extending in a second direction non-parallel to the first direction and having a second cross-sectional area when viewed along a plane normal to the second centerline and intersecting the second leg, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage, wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02 \leq FGF1 \leq 1000$).

A cast engine component for a turbine engine, the cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg having a first centerline extending in a first direction, a second leg having a second centerline extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a smaller of the two radius of curvatures being a radius (R) of the turn, wherein the second core extends a total length along the first centerline and the second centerline, wherein after a casting process, the first core is removed from the cast engine component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage, and a second minimum equivalent diameter ($D2_{eqmin}$) of second core that is representative of a minimum hydraulic diameter of the connecting fluid passage wherein the total length of the second core is greater than or equal to 0.5 times the second equivalent diameter ($D2_{eqmin}$)

A cast component comprising a fluid passage wall separating a first area and a second area, a first core defining at least a portion of the first area or the second area, a second core extending through the fluid passage wall between a first distal end confronting the first area and a second distal end confronting the second area, wherein the second core comprises a first leg having a first centerline extending in a first direction, a second leg having a second centerline extending in a second direction non-parallel to the first direction, the second leg intersecting the first leg at an angle ($\alpha$), and a turn having a first bend and a second bend, the turn being formed along an intersection between the first leg and the second leg and extending along at least a portion of the first leg or the second leg, the first bend and the second bend each being defined by a radius of curvature with a B smaller of the two radius of curvatures being a radius (R) of the turn, wherein the second core extends a total length along the first centerline and the second centerline, wherein after a casting process, the first core is removed from the cast component to define at least one connecting fluid passage and the second core is removed to define a connecting fluid passage interconnecting the first area and the second area, wherein at least a portion of the first core and an entirety of the second core is provided within a geometric boundary defined by a set of geometric characteristics of the first core and the second core within the geometric boundary, the set of geometric characteristics having a first minimum equivalent diameter ($D1_{eqmin}$) of first core that is representative of a minimum hydraulic diameter of the at least one connecting fluid passage a second minimum equivalent diameter ($D2_{eqmin}$) of second core that is representative of a minimum hydraulic diameter of the connecting fluid passage, wherein the total length of the second core is greater than or equal to 0.5 times the second equivalent diameter ($D2_{eqmin}$).

The casting core of any preceding clause, wherein the geometric boundary includes only the second core and a portion of the first core defining the second area, and wherein the second flexible geometry factor (FGF2) is greater than or equal to 0.08 and less than or equal to 400 ($0.08 \leq FGF2 \leq 400$).

The casting core of any preceding clause, wherein the geometric boundary includes only the second core and a portion of the first core defining the first area, and wherein the second flexible geometry factor (FGF2) is greater than or equal to 0.19 and less than or equal to 4000 ($0.19 \leq FGF2 \leq 4000$).

The casting core of any preceding clause, wherein the geometric boundary includes a portion of the first core defining both the first area and the second area, the first minimum equivalent diameter ($D1_{eqmin}$) is an average of a minimum equivalent diameter of the first area and a minimum equivalent diameter of the second area, and wherein the second flexible geometry factor (FGF2) is greater than or equal to 0.02 and less than or equal to 2000 ($0.02 \leq FGF2 \leq 2000$).

The casting core of any preceding clause, wherein the geometric boundary includes only the second core and a portion of the first core defining the second area, and wherein the first flexible geometry factor (FGF1) is greater than or equal to 0.08 and less than or equal to 100 ($0.08 \leq FGF1 \leq 100$).

The casting core of any preceding clause, wherein the geometric boundary includes only the second core and a portion of the first core defining the first area, and wherein the first flexible geometry factor (FGF1) is greater than or equal to 0.19 and less than or equal to 1000 ($0.19 \leq FGF1 \leq 1000$).

The casting core of any preceding clause, wherein the geometric boundary includes a portion of the first core defining both the first area and the second area, the first minimum equivalent diameter ($D1_{eqmin}$) is an average of a minimum equivalent diameter of the first area and a minimum equivalent diameter of the second area, and wherein the first flexible geometry factor (FGF1) is greater than or equal to 0.02 and less than or equal to 500 ($0.02 \leq FGF1 \leq 500$).

The casting core of any preceding clause, wherein a third flexible geometry factor (FGF3) is equal to:

$$FGF3 = \left(\frac{D1_{eq}}{D2_{eq}}\right),$$

and wherein the third flexible geometry factor (FGF3) is greater than or equal to 0.2 and less than or equal to 200 ($0.2 \leq FGF3 \leq 200$).

The casting core of any preceding clause, wherein the geometric boundary includes only the second core and a portion of the first core defining the second area, and wherein the third flexible geometry factor (FGF3) is greater than or equal to 0.5 and less than or equal to 19 ($0.5 \leq FGF3 \leq 19$).

The casting core of any preceding clause, wherein the geometric boundary includes only the second core and a portion of the first core defining the first area, and wherein the third flexible geometry factor (FGF3) is greater than or equal to 1 and less than or equal to 200 ($1 \leq FGF3 \leq 200$).

The casting core or any preceding clause, wherein the geometric boundary includes a portion of the first core defining both the first area and the second area, the first minimum equivalent diameter ($D1_{eqmin}$) is an average of a minimum equivalent diameter of the first area and a minimum equivalent diameter of the second area, and wherein the third flexible geometry factor (FGF3) is greater than or equal to 0.2 and less than or equal to 100 ($0.2 \leq FGF3 \leq 100$).

The cast engine component of any preceding clause, wherein the geometric boundary includes only the second core and a portion of the first core defining the second area, and wherein the third flexible geometry factor (FGF3) is greater than or equal to 0.5 and less than or equal to 19 ($0.5 \leq FGF3 \leq 19$).

The cast engine component of any preceding clause, wherein the geometric boundary includes only the second core and a portion of the first core defining the first area, and wherein the third flexible geometry factor (FGF3) is greater than or equal to 1 and less than or equal to 200 ($1 \leq FGF3 \leq 200$).

The cast engine component of any preceding clause, wherein the geometric boundary includes a portion of the first core defining both the first area and the second area, the first minimum equivalent diameter ($D1_{eqmin}$) is an average of a minimum equivalent diameter of the first area and a minimum equivalent diameter of the second area, and wherein the third flexible geometry factor (FGF3) is greater than or equal to 0.2 and less than or equal to 100 ($0.2 \leq FGF3 \leq 100$).

The cast engine component of any preceding clause, wherein the connecting fluid passage is a film hole and at least one of the first area or the second area forms a portion of the film hole, or wherein the connecting fluid passage is a linking cavity and the first area and the second area are both internal fluid paths.

The cast engine component of any preceding clause, wherein the second area is a portion exterior the cast engine component and is not defined by the first core.

The cast engine component of any preceding clause, wherein the first core is separate from the second core.

The cast engine component of any preceding clause, wherein the first core includes one of either a ceramic or a refractory metal, and the second core includes one of another, with respect to the first core, of one of either a ceramic or a refractory metal.

The cast engine component of any preceding clause, wherein the connecting fluid passage is a tie bar.

The cast engine component of any preceding clause, wherein the first core and the second core are a continuous core.

The cast engine component of any preceding clause, wherein the cast engine component is an airfoil and the fluid passage wall is one of either an interior wall within an interior of the airfoil or an outer wall of the airfoil.

The cast engine component of any preceding clause, wherein fluid passage wall is an outer wall of the cast engine component and the second area is exterior the wall.

The cast engine component of any preceding clause, wherein the first core and the second core are each removed via leaching.

The cast engine component of any preceding clause, wherein at least one of either the first leg or the second leg form an intersection with one of either the first area or the second area to form an angle ($\alpha$) with respect to the first leg or the second leg, respectively, and a plane parallel to the interface between the first leg or the second leg, and the first area or the second area, with $\sigma$ being greater than or equal to 15 degrees and less than or equal to 165 degrees (15 degrees$\leq\sigma\leq$165 degrees).

The cast engine component of any preceding clause, wherein the engine component is an airfoil and the fluid passage wall is one of either an interior wall within an interior of the airfoil or an outer wall of the airfoil.

The cast engine component of any preceding clause, wherein the first angle ($\sigma_1$) is equal to the second angle ($\sigma_2$).

The cast engine component of any preceding clause, wherein the first angle ($\sigma_1$) is non-equal to the second angle ($\sigma_2$).

The cast engine component of any preceding clause, wherein the first angle ($\sigma_1$) is equal in magnitude to the second angle ($\sigma_2$).

The cast engine component of any preceding clause, wherein the first angle ($\sigma_1$) is non-equal in magnitude to the second angle ($\sigma_2$).

The cast engine component of any preceding clause, wherein the first leg meets the second leg at an intersection within the fluid passage wall, and wherein an angle ($\alpha$) of greater than 0 degrees and less than 180 degrees is defined at the intersection ($0°\leq\alpha\leq180°$).

The cast engine component of any preceding clause, wherein during a casting process, the first area, the second area, and at least one connecting fluid passage are defined by at least one core.

The cast engine component of any preceding clause, wherein the at least one core is a continuous core.

The cast engine component of any preceding clause, wherein the continuous core includes a ceramic.

The cast engine component of any preceding clause, wherein the at least one core includes a first core defining at least one of the first area or the second area and a second core separate from the first core and defining the entirety of the at least one connecting fluid passage, The cast engine component of any preceding clause, wherein the first leg meets the second leg at an intersection within the fluid passage wall, and wherein an angle ($\alpha$) of greater than 0 degrees and less than 180 degrees is defined at the intersection ($0°\leq\alpha\leq180°$), the at least one connecting fluid passage further comprising a turn having an first bend and an second bend, the turn being formed along an intersection between the first leg and the second leg and extending along at least a portion of the first leg or the second leg, the first bend and the second bend each being defined by a radius of curvature with a B smaller of the two radius of curvatures being a radius (R) of the turn, wherein during a casting process, the first area, the second area, and at least one connecting fluid passage are defined by at least one core, wherein a portion of the at least one core within a geometric boundary including the at least one connecting fluid passage and at least a portion of the first area or the second area is defined by a set of geometric characteristics of the at least one connecting fluid passage and at least one of the first area or the second area, the set of geometric characteristics having a first minimum equivalent diameter ($D1_{eqmin}$) of at least one of the first area or the second area, and a second minimum equivalent diameter ($D2_{eqmin}$) of the at least one connecting fluid passage wherein a first flexible geometry factor (FGF1) is equal to:

$$\left(\frac{D1_{eqmin}}{D2_{eqmin}}\right)\left(\frac{R}{D2_{eqmin}}\right),$$

and wherein the first flexible geometry factor (FGF1) is greater than or equal to 0.02 and less than or equal to 1000 ($0.02\leq FGF1\leq1000$).

The cast engine component of any preceding clause, wherein the first area is a portion of the plurality of connecting fluid passages and interconnects the plurality of connecting fluid passages.

The cast engine component of any preceding clause, wherein the first area is formed within the fluid passage wall.

The cast engine component of any preceding clause, wherein the plurality of connecting fluid passages are a plurality of film holes and at least one of the first area or the second area forms a portion of at least one of the plurality of film holes, or wherein the at least one connecting fluid passage is a linking cavity and the first area and the second area are internal connecting fluid passages.

The cast engine component of any preceding clause, wherein the at least one core includes a first core defining at least one of the first area or the second area and a second core separate from the first core and defining the entirety of the at least one connecting fluid passage, The cast engine component of any preceding clause, wherein the first cross-sectional area is non-equal to the second cross-sectional area.

The cast engine component of any preceding clause, wherein the first cross sectional area is non-linear between distal ends of the first leg.

The cast engine component of any preceding clause, wherein the first cross sectional area is linear between distal ends of the first leg.

The cast engine component of any preceding clause, wherein the second cross sectional area is non-linear between distal ends of the second leg.

The cast engine component of any preceding clause, wherein the second cross sectional area is linear between distal ends of the second leg.

The casting core of any preceding clause, wherein at least one of the first area or the second area is formed within the fluid passage wall.

The casting core of any preceding clause, wherein one of either the first area and the second area are both interior portions of the cast engine component and the connecting fluid passage is a tie bar, or the first area is an interior portion of the cast engine component, the second area is exterior the cast engine component and the connecting fluid passage is a film hole.

The casting core of any preceding clause, wherein the cast engine component is provided within a turbine engine and is one of an airfoil, a heat exchanger, or a liner.

What is claimed is:

1. A casting core used in manufacture of a cast engine component for a turbine engine, the cast engine component having a first area, a second area, a fluid passage wall separating the first area and the second area, and a connecting fluid passage extending through the fluid passage wall and interconnecting the first area and the second area, the casting core comprising:

a first core corresponding to at least one of the first area or the second area of the cast engine component; and a second core corresponding to the connecting fluid passage of the cast engine component, the second core further defining:

a first leg of the connecting fluid passage extending in a first direction;

a second leg of the connecting fluid passage extending in a second direction non-parallel to the first direction, the second leg intersecting the first leg at an angle ($\alpha$), with a normalized angle of $$\frac{\alpha}{45^\circ}$$

being greater than or equal to 0.5 and less than or equal to $$3.67\ \left(0.5 < \frac{\alpha}{45^\circ} < 3.67\right);$$

and a turn of the connecting fluid passage formed along an intersection between the first leg and the second leg and extending along at least a portion of the first leg or the second leg, the turn having a first bend with a first radius of curvature and a second bend with a second radius of curvature, with the smallest of the first and second radius of curvature defining a radius (R) of the turn, the radius (R) being greater than or equal to 0.005 inches and less than or equal to 0.05 inches ($0.005<R<0.05$);

wherein after a casting process, the first core and the second core are each removed to define voids formed within the cast engine component;

wherein at least a portion of the first core and an entirety of the second core is provided within a geometric boundary defined by a set of geometric characteristics of the first core and the second core within the geometric boundary, the set of geometric characteristics having:

a first minimum equivalent diameter ($D1_{eqmin}$) of the first core that is representative of a minimum hydraulic diameter of at least one of the first area or the second area within the geometric boundary, the first minimum equivalent diameter ($D1_{eqmin}$) being greater than or equal to 0.015 inches and less than or equal to 1 inch ($0.015<D1_{eqmin}<1$); and a second minimum equivalent diameter ($D2_{eqmin}$) of the second core that is representative of a minimum hydraulic diameter of the connecting fluid passage within the geometric boundary, the second minimum equivalent diameter ($D2_{eqmin}$) being greater than or equal to 0.005 inches and less than or equal to 0.2 inches ($0.005<D2_{eqmin}<0.2$);

wherein a first flexible geometry factor (FGF1) is equal to:

$$\left(\frac{D1_{eqmin}}{D2_{eqmin}}\right)\left(\frac{R}{D2_{eqmin}}\right);$$

and wherein the first flexible geometry factor (FGF1) is greater than or equal to 0.024 and less than or equal to 1000 ($0.024 \leq FGF1 \leq 1000$).

2. The casting core of claim 1, wherein a second flexible geometry factor (FGF2) is equal to:

$$\left(\frac{D1_{eqmin}}{D2_{eqmin}}\right)\left(\frac{R}{D2_{eqmin}}\right)\left(\frac{\alpha}{45^\circ}\right),$$

and wherein the second flexible geometry factor (FGF2) is greater than or equal to 0.024 and less than or equal to 3670 ($0.024 \leq FGF2 \leq 3670$).

3. The casting core of claim 2, wherein:

the geometric boundary includes only the second core and a portion of the first core defining the second area;

the radius (R) being greater than or equal to 0.005 inches and less than or equal to 0.025 inches ($0.005<R<0.025$);

the first minimum equivalent diameter ($D1_{eqmin}$) is greater than or equal to 0.015 inches and less than or equal to 0.091 inches ($0.015<D1_{eqmin}<0.091$);

the second minimum equivalent diameter ($D2_{eqmin}$) being greater than or equal to 0.005 inches and less than or equal to 0.03 inches ($0.005<D2_{eqmin}<0.03$); and the second flexible geometry factor (FGF2) is greater than or equal to 0.083 and less than or equal to 336.636 ($0.083 \leq FGF2 \leq 336.636$).

4. The casting core of claim 2, wherein:

the geometric boundary includes only the second core and a portion of the first core defining the first area;

the radius (R) being greater than or equal to 0.005 inches and less than or equal to 0.025 inches ($0.005<R<0.025$);

the first minimum equivalent diameter ($D1_{eqmin}$) is greater than or equal to 0.034 inches and less than or equal to 1 inch ($0.034<D1_{eqmin}<1$);

the second minimum equivalent diameter ($D2_{eqmin}$) being greater than or equal to 0.005 inches and less than or equal to 0.03 inches ($0.005<D2_{eqmin}<0.03$); and the second flexible geometry factor (FGF2) is greater than or equal to 0.191 and less than or equal to 3670 ($0.191 \leq FGF2 \leq 3670$).

5. The casting core of claim 2, wherein:

the geometric boundary includes a portion of the first core defining both the first area and the second area;

the first minimum equivalent diameter ($D1_{eqmin}$) is an average of a minimum equivalent diameter of the first area and a minimum equivalent diameter of the second area;

the first minimum equivalent diameter ($D1_{eqmin}$) is greater than or equal to 0.017 inches and less than or equal to 1 inch ($0.017<D1_{eqmin}<1$);

the second minimum equivalent diameter ($D2_{eqmin}$) being greater than or equal to 0.01 inches and less than or equal to 0.2 inches ($0.01<D2_{eqmin}<0.2$); and the second flexible geometry factor (FGF2) is greater than or equal to 0.024 and less than or equal to 1835 ($0.024 \leq FGF2 \leq 1835$).

6. The casting core of claim 1, wherein:

the geometric boundary includes only the second core and a portion of the first core defining the second area;

the radius (R) being greater than or equal to 0.005 inches and less than or equal to 0.025 inches ($0.005<R<0.025$);

the first minimum equivalent diameter ($D1_{eqmin}$) is greater than or equal to 0.015 inches and less than or equal to 0.091 inches ($0.015<D1_{eqmin}<0.091$);

the second minimum equivalent diameter ($D2_{eqmin}$) being greater than or equal to 0.005 inches and less than or equal to 0.03 inches ($0.005<D2_{eqmin}<0.03$); and the first flexible geometry factor (FGF1) is greater than or equal to 0.083 and less than or equal to 90.909 ($0.083\leq FGF1\leq 90.909$).

7. The casting core of claim 1, wherein:

the geometric boundary includes only the second core and a portion of the first core defining the first area;

the radius (R) being greater than or equal to 0.005 inches and less than or equal to 0.025 inches ($0.005<R<0.025$);

the first minimum equivalent diameter ($D1_{eqmin}$) is greater than or equal to 0.034 inches and less than or equal to 1 inch ($0.034<D1_{eqmin}<1$);

the second minimum equivalent diameter ($D2_{eqmin}$) being greater than or equal to 0.005 inches and less than or equal to 0.03 inches ($0.005<D2_{eqmin}<0.03$); and the first flexible geometry factor (FGF1) is greater than or equal to 0.191 and less than or equal to 1000 ($0.191\leq FGF1\leq 1000$).

8. The casting core of claim 1, wherein:

the geometric boundary includes a portion of the first core defining both the first area and the second area;

the first minimum equivalent diameter ($D1_{eqmin}$) is an average of a minimum equivalent diameter of the first area and a minimum equivalent diameter of the second area;

the first minimum equivalent diameter ($D1_{eqmin}$) is greater than or equal to 0.017 inches and less than or equal to 1 inch ($0.017<D1_{eqmin}<1$);

the second minimum equivalent diameter ($D2_{eqmin}$) being greater than or equal to 0.01 inches and less than or equal to 0.2 inches ($0.01<D2_{eqmin}<0.2$); and the first flexible geometry factor (FGF1) is greater than or equal to 0.024 and less than or equal to 500 ($0.024\leq FGF1\leq 500$).

9. The casting core of claim 1, wherein a third flexible geometry factor (FGF3) is equal to:

$$FGF3 = \left(\frac{D1_{eq}}{D2_{eq}}\right),$$

and wherein the third flexible geometry factor (FGF3) is greater than or equal to 0.286 and less than or equal to 200 ($0.286\leq FGF3\leq 200$).

10. The casting core of claim 9, wherein:

the geometric boundary includes only the second core and a portion of the first core defining the second area;

the radius (R) being greater than or equal to 0.005 inches and less than or equal to 0.025 inches ($0.005<R<0.025$);

the first minimum equivalent diameter ($D1_{eqmin}$) is greater than or equal to 0.015 inches and less than or equal to 0.091 inches ($0.015<D1_{eqmin}<0.091$);

the second minimum equivalent diameter ($D2_{eqmin}$) being greater than or equal to 0.005 inches and less than or equal to 0.03 inches ($0.005<D2_{eqmin}<0.03$); and the third flexible geometry factor (FGF3) is greater than or equal to 0.5 and less than or equal to 18.182 ($0.5\leq FGF3\leq 18.182$).

11. The casting core of claim 9, wherein:

the geometric boundary includes only the second core and a portion of the first core defining the first area;

the radius (R) being greater than or equal to 0.005 inches and less than or equal to 0.025 inches ($0.005<R<0.025$);

the first minimum equivalent diameter ($D1_{eqmin}$) is greater than or equal to 0.034 inches and less than or equal to 1 inch ($0.034<D1_{eqmin}<1$);

the second minimum equivalent diameter ($D2_{eqmin}$) being greater than or equal to 0.005 inches and less than or equal to 0.03 inches ($0.005<D2_{eqmin}<0.03$); and the third flexible geometry factor (FGF3) is greater than or equal to 1.143 and less than or equal to 200 ($1.143\leq FGF3\leq 200$).

12. The casting core of claim 9, wherein:

the geometric boundary includes a portion of the first core defining both the first area and the second area;

the first minimum equivalent diameter ($D1_{eqmin}$) is an average of a minimum equivalent diameter of the first area and a minimum equivalent diameter of the second area;

the first minimum equivalent diameter ($D1_{eqmin}$) is greater than or equal to 0.017 inches and less than or equal to 1 inch ($0.017<D1_{eqmin}<1$);

the second minimum equivalent diameter ($D2_{eqmin}$) being greater than or equal to 0.01 inches and less than or equal to 0.2 inches ($0.01<D2_{eqmin}<0.2$); and the third flexible geometry factor (FGF3) is greater than or equal to 0.286 and less than or equal to 100 ($0.286\leq FGF3\leq 100$).

13. The casting core of claim 1, wherein at least one of the first area or the second area is formed within the fluid passage wall, and wherein one of either:

the first area and the second area are both interior portions of the cast engine component and the connecting fluid passage is a tie bar; or the first area is an interior portion of the cast engine component, the second area is exterior the cast engine component and the connecting fluid passage is a film hole.

14. The casting core of claim 1, wherein the second area is a portion exterior the cast engine component and is not defined by the first core.

15. The casting core of claim 1, wherein the first core is separate from the second core.

16. The casting core of claim 15, wherein the first core includes one of either a ceramic or a refractory metal, and the second core includes the other of the ceramic or the refractory metal.

17. The casting core of claim 1, wherein the first core and the second core are a continuous core.

18. The casting core of claim 1, wherein the cast engine component is an airfoil and the fluid passage wall is one of either an interior wall within an interior of the airfoil or an outer wall of the airfoil.

19. A casting core used in manufacture of a cast component having a first area, a second area, a fluid passage wall separating the first area and the second area, and a connecting fluid passage extending through the fluid passage wall and interconnecting the first area and the second area, the casting core comprising:

a first core corresponding to at least one of the first area or the second area of the cast component; and a second core corresponding to the connecting fluid passage of the cast component, the second core further defining:

a first leg of the connecting fluid passage extending in a first direction;

a second leg of the connecting fluid passage extending in a second direction non-parallel to the first direction, the second leg intersecting the first leg at an angle ($\alpha$), with a normalized angle of $$3.67\left(0.5 < \frac{\alpha}{45^\circ} < 3.67\right);$$

being greater than or equal to 0.5 and less than or equal to 3.67

$$3.67\left(0.5 < \frac{\alpha}{45^\circ} < 0.05\right);$$

and a turn of the connecting fluid passage formed along an intersection between the first leg and the second leg and extending along at least a portion of the first leg or the second leg, the turn having a first bend with a first radius of curvature and a second bend with a second radius of curvature, with the smallest of the first and second radius of curvature defining a radius (R) of the turn, the radius (R) being greater than or equal to 0.005 inches and less than or equal to 0.05 inches ($0.005<R<0.05$);

wherein after a casting process, the first core and the second core are each removed to define voids formed within the cast component;

wherein at least a portion of the first core and an entirety of the second core is provided within a geometric boundary defined by a set of geometric characteristics of the first core and the second core within the geometric boundary, the set of geometric characteristics having:

a first minimum equivalent diameter ($D1_{eqmin}$) of the first core that is representative of a minimum hydraulic diameter of at least one of the first area or the second area within the geometric boundary, the first minimum equivalent diameter ($D1_{eqmin}$) being greater than or equal to 0.015 inches and less than or equal to 1 inch ($0.015<D1_{eqmin}<1$); and a second minimum equivalent diameter ($D2_{eqmin}$) of the second core that is representative of a minimum hydraulic diameter of the connecting fluid passage within the geometric boundary, the second minimum equivalent diameter ($D2_{eqmin}$) being greater than or equal to 0.005 inches and less than or equal to 0.2 inches ($0.005<D2_{eqmin}<0.2$);

wherein a first flexible geometry factor (FGF1) is equal to:

$$\left(\frac{D1_{eqmin}}{D2_{eqmin}}\right)\left(\frac{R}{D2_{eqmin}}\right);$$

wherein the first flexible geometry factor (FGF1) is greater than or equal to 0.024 and less than or equal to 1000 ($0.024 \leq FGF1 \leq 1000$).

20. The casting core of claim 19, wherein the cast component is provided within a turbine engine and is one of an airfoil, a heat exchanger, or a liner.

* * * * *